US006494264B2

(12) United States Patent
Pringle et al.

(10) Patent No.: US 6,494,264 B2
(45) **Date of Patent: *Dec. 17, 2002**

(54) WELLBORE FLOW CONTROL DEVICE

(75) Inventors: Ronald E. Pringle, Houston, TX (US); Dwyane D. Leismer, Pearland, TX (US); Clay W. Milligan, Jr., Missouri City, TX (US)

(73) Assignee: Schlumberger Technology Corporation

( * ) Notice: Subject to any disclaimer, the term of this patent is extended or adjusted under 35 U.S.C. 154(b) by 0 days.

This patent is subject to a terminal disclaimer.

(21) Appl. No.: 09/955,728

(22) Filed: Sep. 19, 2001

(65) Prior Publication Data

US 2002/0029886 A1 Mar. 14, 2002

Related U.S. Application Data

(63) Continuation of application No. 09/729,545, filed on Dec. 4, 2000, now Pat. No. 6,308,783, which is a division of application No. 09/192,855, filed on Nov. 17, 1998, now Pat. No. 6,237,683, which is a continuation-in-part of application No. 08/638,027, filed on Apr. 26, 1996, now Pat. No. 5,918,669.

(51) Int. Cl.[7] ..... E21B 34/14; E21B 43/12

(52) U.S. Cl. ..... 166/313; 166/50; 166/191; 166/320; 166/330

(58) Field of Search ..... 166/50, 66.4, 66.6, 166/117.6, 191, 313, 320, 330, 332.2, 332.4, 373

(56) References Cited

U.S. PATENT DOCUMENTS

| | | | | | |
|---|---|---|---|---|---|
| 4,350,205 | A | * | 9/1982 | Goldschild et al. | 166/375 |
| 4,796,708 | A | * | 1/1989 | Lembcke | 166/66.4 X |
| 4,942,926 | A | * | 7/1990 | Lessi | 166/50 X |
| 5,226,491 | A | * | 7/1993 | Pringle et al. | 166/66.4 |
| 5,337,808 | A | * | 8/1994 | Graham | 166/191 |
| 5,447,201 | A | * | 9/1995 | Mohm | 166/375 |
| 5,531,270 | A | * | 7/1996 | Fletcher et al. | 166/53 |
| 5,564,503 | A | * | 10/1996 | Longbottom et al. | 166/313 |
| 5,597,042 | A | * | 1/1997 | Tubel et al. | 166/250.01 |
| 5,918,669 | A | * | 7/1999 | Morris et al. | 166/50 |

* cited by examiner

*Primary Examiner*—George Suchfield
(74) *Attorney, Agent, or Firm*—Brigitte L. Jeffery; Jeffrey E. Griffin; Brigitte L. Jeffrey

(57) ABSTRACT

One embodiment of the present invention provides a multilateral production system. The production system has one or more flow control valves for controlling flow from the one or more lateral bores, and has a main flow control valve for controlling flow from the main bore. All flow control valves are in communication with the main wellbore.

15 Claims, 42 Drawing Sheets

178
132
172
168
130
196
198
160
166
194
184
13
13
170
174
190
164
182

204
226
206
202
234
232

202
206
236
204
226
18
18
207
205
205
210
210
209
216
214
216
19
19
208
208
212

212
202
217
219
226
236
212
238
20
221
20
218
240
204
220

256
25
25
270
266
264
267
276
274
26
26
262
262
272
278
278
280
280
282

WELLBORE FLOW CONTROL DEVICE

RELATED APPLICATIONS

This application is a continuation of U.S. application Ser. No. 09/729,545, filed Dec. 4, 2000 now U.S. Pat. No. 6,308,783, which is a divisional of U.S. application Ser. No. 09/192,855, filed Nov. 17, 1998, now U.S. Pat. No. 6,237,683, which is a continuation-in-part of U.S. application Ser. No. 08/638,027, filed Apr. 26, 1996, now U.S. Pat. No. 5,918,669.

BACKGROUND OF THE INVENTION

1. Field of the Invention

The present invention relates to subsurface well completion equipment and, more particularly, to methods and related apparatus for remotely controlling fluid recovery from multiple laterally drilled wellbores.

2. Description of the Related Art

Hydrocarbon recovery volume from a vertically drilled well can be increased by drilling additional wellbores from that same well. For example, the fluid recovery rate and the well's economic life can be increased by drilling a horizontal or highly deviated interval from a main wellbore radially outward into one or more formations. Still further increases in recovery and well life can be attained by drilling multiple deviated intervals into multiple formations. Once the multilateral wellbores have been drilled and completed there is a need for the recovery of fluids from each wellbore to be individually controlled. Currently, the control of the fluid recovery from these multilateral wellbores has been limited in that once a lateral wellbore has been opened it is not possible to selectively close off and/or reopen the lateral wellbores without the need for the use of additional equipment, such as wireline units, coiled tubing units and workover rigs.

The need for selective fluid recovery is important in that individual producing intervals usually contain hydrocarbons that have different physical and chemical properties and as such may have different unit values. Co-mingling a valuable and desirable crude with one that has, for instance, a high sulfur content would not be commercially expedient, and in some cases is prohibited by governmental regulatory authorities. Also, because different intervals inherently contain differing volumes of hydrocarbons, it is highly probable that one interval will deplete before the others, and will need to be easily and inexpensively closed off from the vertical wellbore before the other intervals.

The use of workover rigs, coiled tubing units and wireline units are relatively inexpensive if used onshore and in typical oilfield locations; however, mobilizing these resources for a remote offshore well can be very expensive in terms of actual dollars spent, and in terms of lost production while the resources are being moved on site. In the case of subsea wells (where no surface platform is present), a drill ship or workover vessel mobilization would be required to merely open/close a downhole wellbore valve.

The following patents disclose the current multilateral drilling and completion techniques. U.S. Pat. No. 4,402,551 details a simple completion method when a lateral wellbore is drilled and completed through a bottom of an existing traditional, vertical wellbore. Control of production fluids from a well completed in this manner is by traditional surface wellhead valving methods, since improved methods of recovery from only one lateral and one interval is disclosed. The importance of this patent is the recognition of the role of orienting and casing the lateral wellbore, and the care taken in sealing the juncture where the vertical borehole interfaces with the lateral wellbore.

U.S. Pat. No. 5,388,648 discloses a method and apparatus for sealing the juncture between one or more horizontal wells using deformable sealing means. This completion method deals primarily with completion techniques prior to insertion of production tubing in the well. While it does address the penetration of multiple intervals at different depths in the well, it does not offer solutions as to how these different intervals may be selectively produced.

U.S. Pat. No. 5,337,808 discloses a technique and apparatus for selective multi-zone vertical and/or horizontal completions. This patent illustrates the need to selectively open and close individual intervals in wells where multiple intervals exist, and discloses devices that isolate these individual zones through the use of workover rigs.

U.S. Pat. No. 5,447,201 discloses a well completion system with selective remote surface control of individual producing zones to solve some of the above described problems. Similarly, U.S. Pat. No. 5,411,085, commonly assigned hereto, discloses a production completion system which can be remotely manipulated by a controlling means extending between downhole components and a panel located at the surface. Each of these patents, while able to solve recovery problems without a workover rig, fails to address the unique problems associated with multilateral wells, and teaches only recovery methods from multiple interval wells. A multilateral well that requires reentry remediation which was completed with either of these techniques has the same problems as before: the production tubing would have to be removed, at great expense, to re-enter the lateral for remediation, and reinserted in the well to resume production.

U.S. Pat. No. 5,474,131 discloses a method for completing multi-lateral wells and maintaining selective re-entry into the lateral wellbores. This method allows for re-entry remediation into deviated laterals, but does not address the need to remotely manipulate downhole completion accessories from the surface without some intervention technique. In this patent, a special shifting tool is required to be inserted in the well on coiled tubing to engage a set of ears to shift a flapper valve to enable selective entry to either a main wellbore or a lateral. To accomplish this, the well production must be halted, a coiled tubing company called to the job site, a surface valving system attached to the wellhead must be removed, a blow out preventer must be attached to the wellhead, a coiled tubing injector head must be attached to the blow out preventer, and the special shifting tool must be attached to the coiled tubing; all before the coiled tubing can be inserted to the well.

There is a need for a system to allow an operator standing at a remote control panel to selectively permit and prohibit flow from multiple lateral well branches drilled from a common central wellbore without having to resort to common intervention techniques. Alternately, there is a need for an operator to selectively open and close a valve to implement re-entry into a lateral branch drilled from the common wellbore. There is a need for redundant power sources to assure operation of these automated downhole devices, should one or more power sources fail. Finally, there is a need for the fail safe mechanical recovery tools, should these automated systems become inoperative.

BRIEF DESCRIPTION OF THE DRAWINGS

FIG. 4-A depicts the cross section with a rotating lateral access door shown in the open position, while FIG. 4-B depicts the cross section with the rotating lateral access door shown in the closed position.

DETAILED DESCRIPTION OF THE INVENTION

The present invention is a system for remotely controlling multilateral wells, and will be described in conjunction with its use in a well with three producing formations for purposes of illustration only. One skilled in the art will appreciate many differing applications of the described apparatus. It should be understood that the described invention may be used in multiples for any well with a plurality of producing formations's where either multiple lateral branches of a well are present, or multiple producing formations that are conventionally completed, such as by well perforations or uncased open hole, or by any combination of these methods. Specifically, the apparatus of the present invention includes enabling devices for automated remote control and access of multiple formations in a central wellbore during production, and allow work and time saving intervention techniques when remediation becomes necessary.

For the purposes of this discussion, the terms "upper" and "lower", "up hole" and "downhole", and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Figure 1:
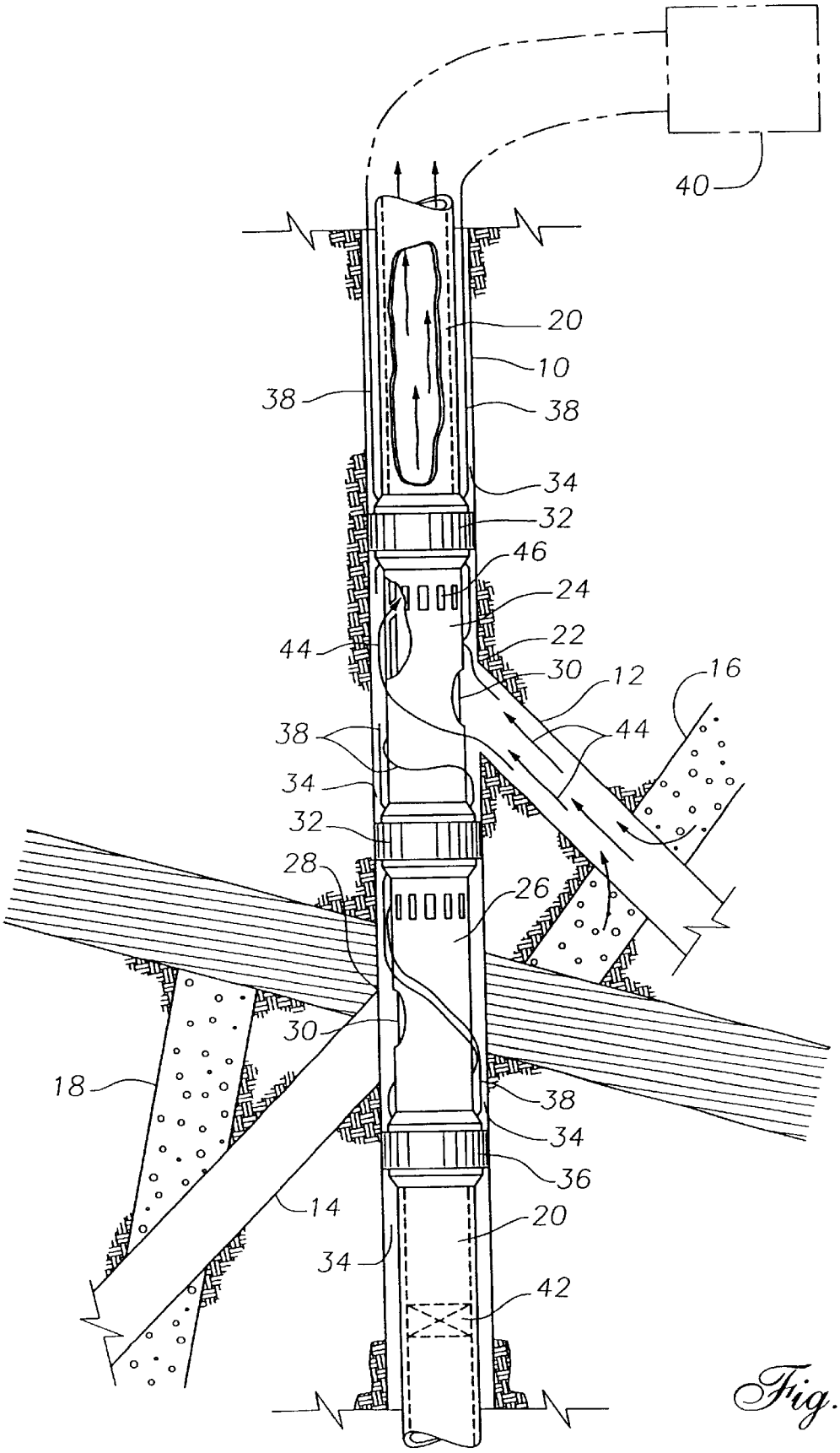
FIG. 1 is a schematic representation of a wellbore completed using one preferred embodiment of present invention.
Figure 2A:
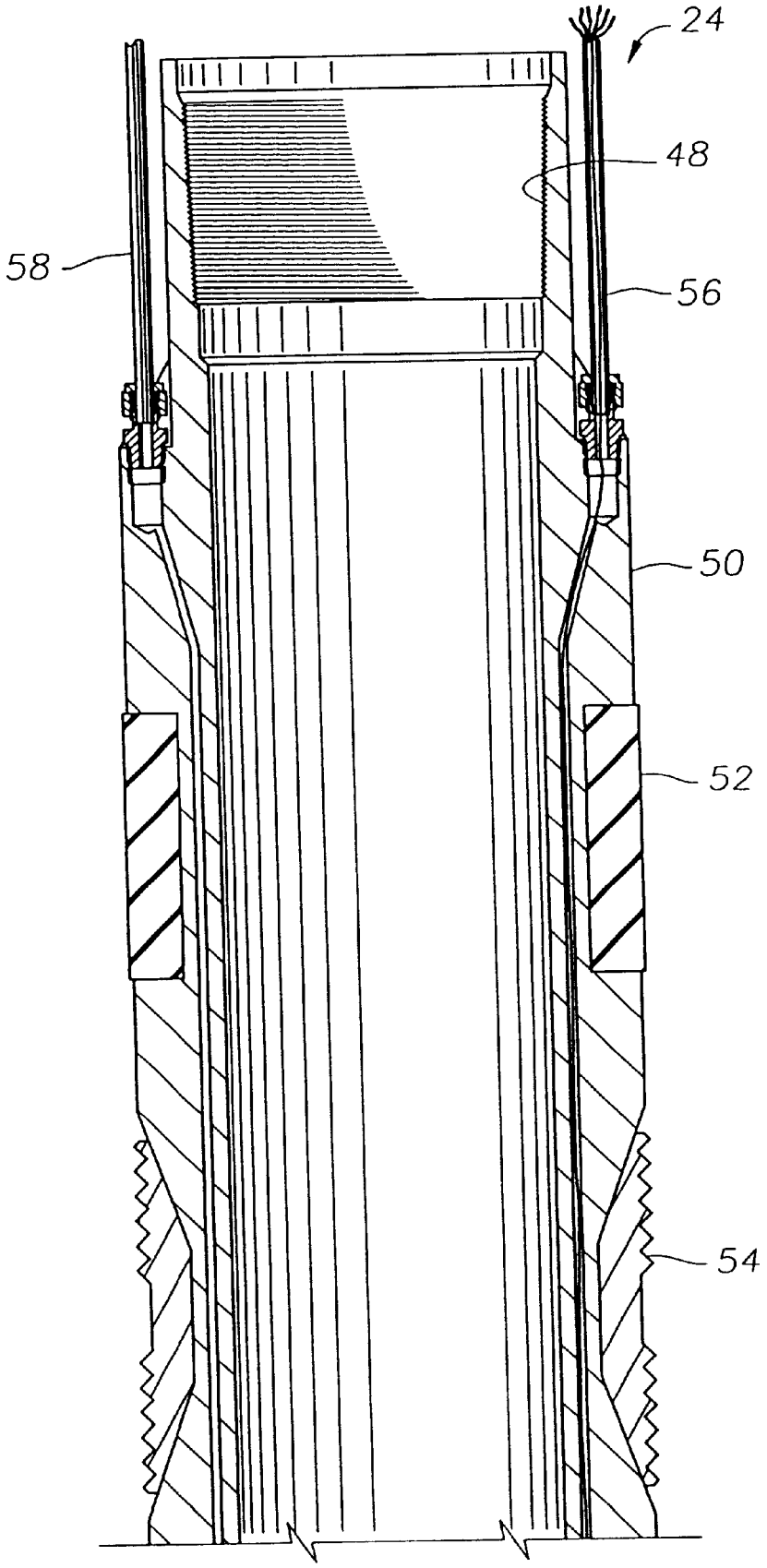
FIGS. 2 A–G taken together form a longitudinal section of one preferred embodiment of an apparatus of the present invention with a lateral access door in the open position.
Figure 2B:
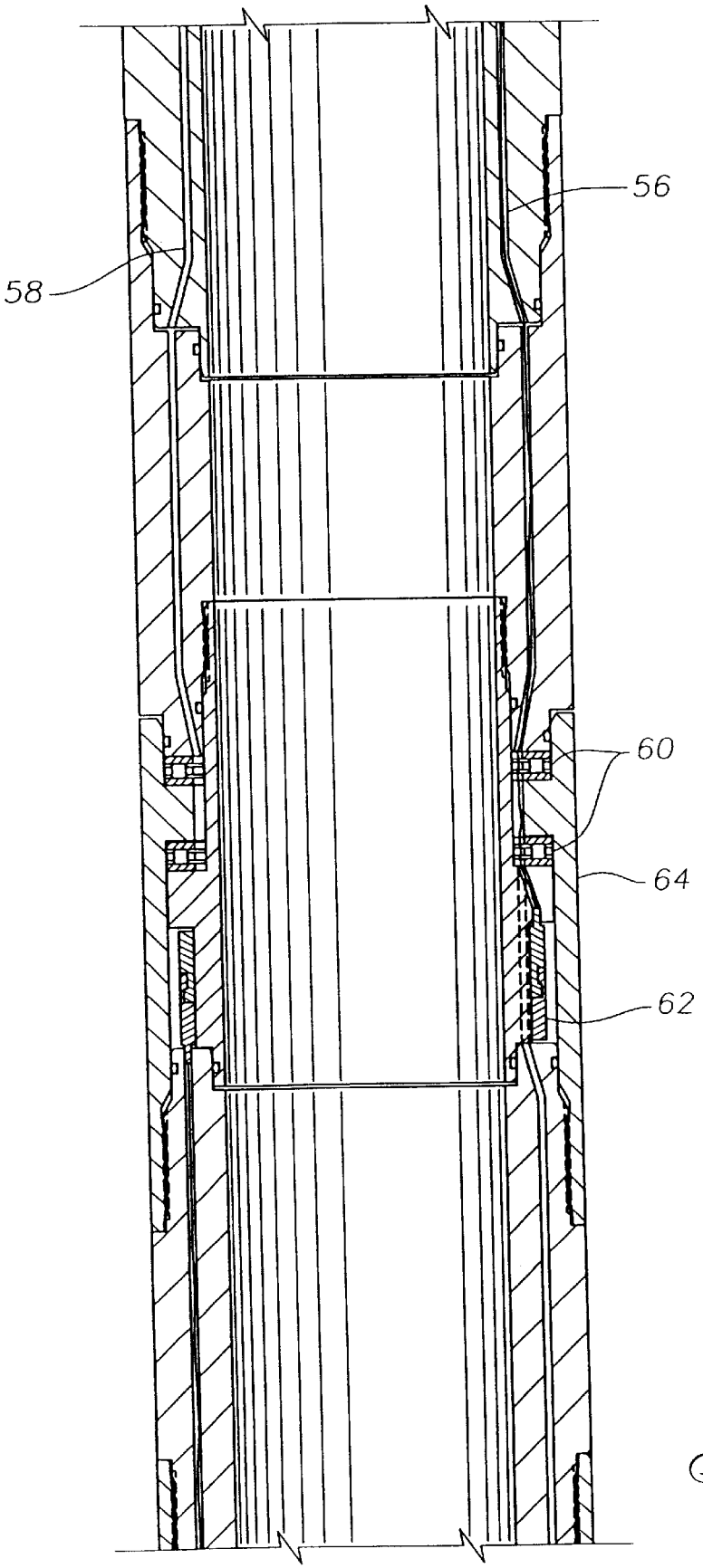
Figure 2C:
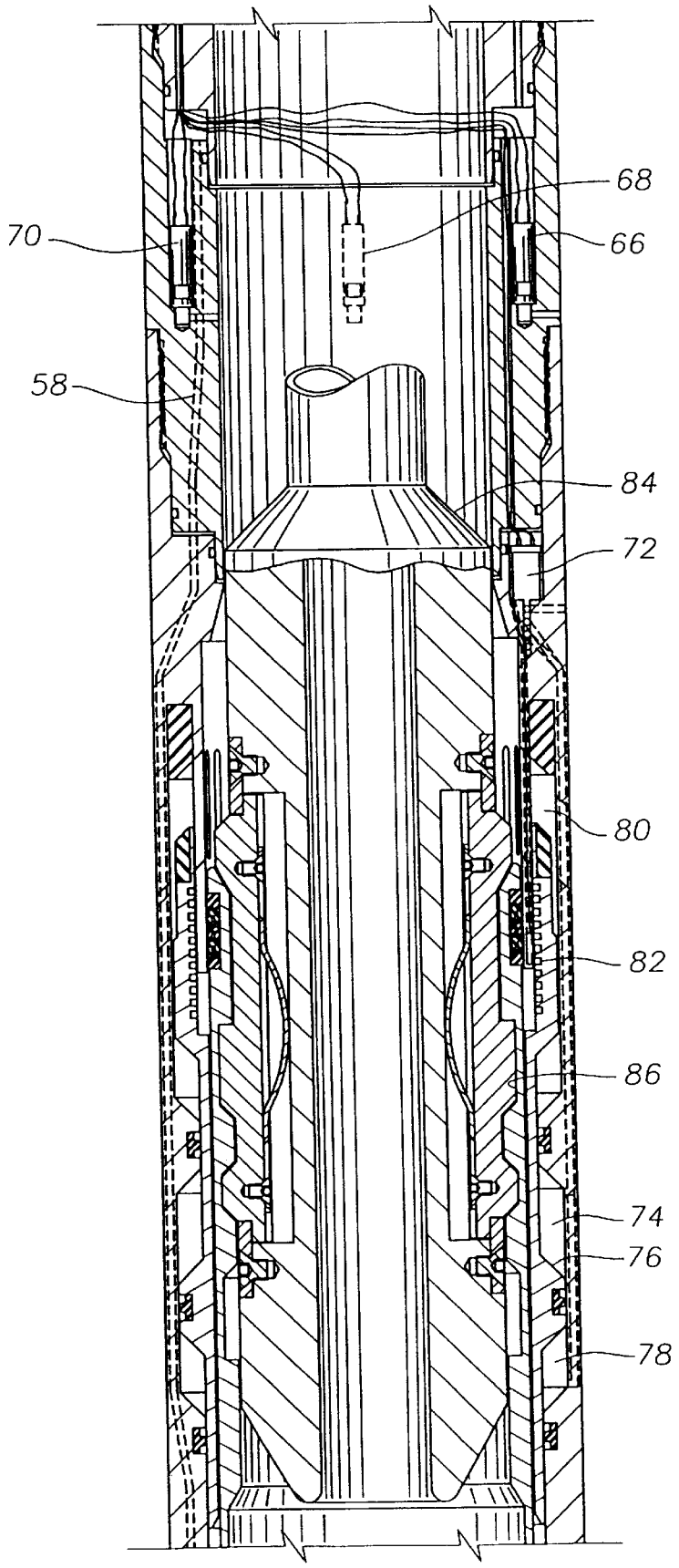
Figure 2D:
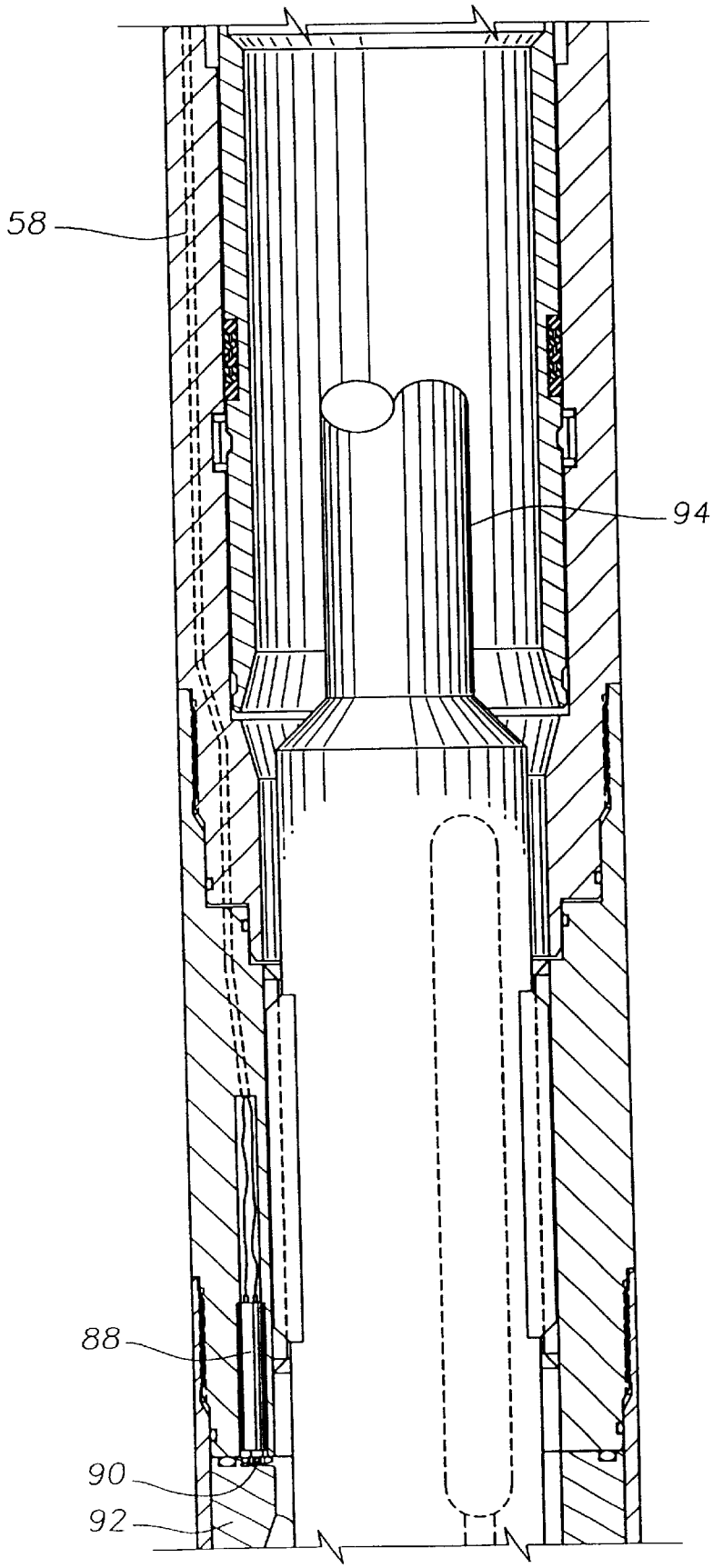
Figure 2E:
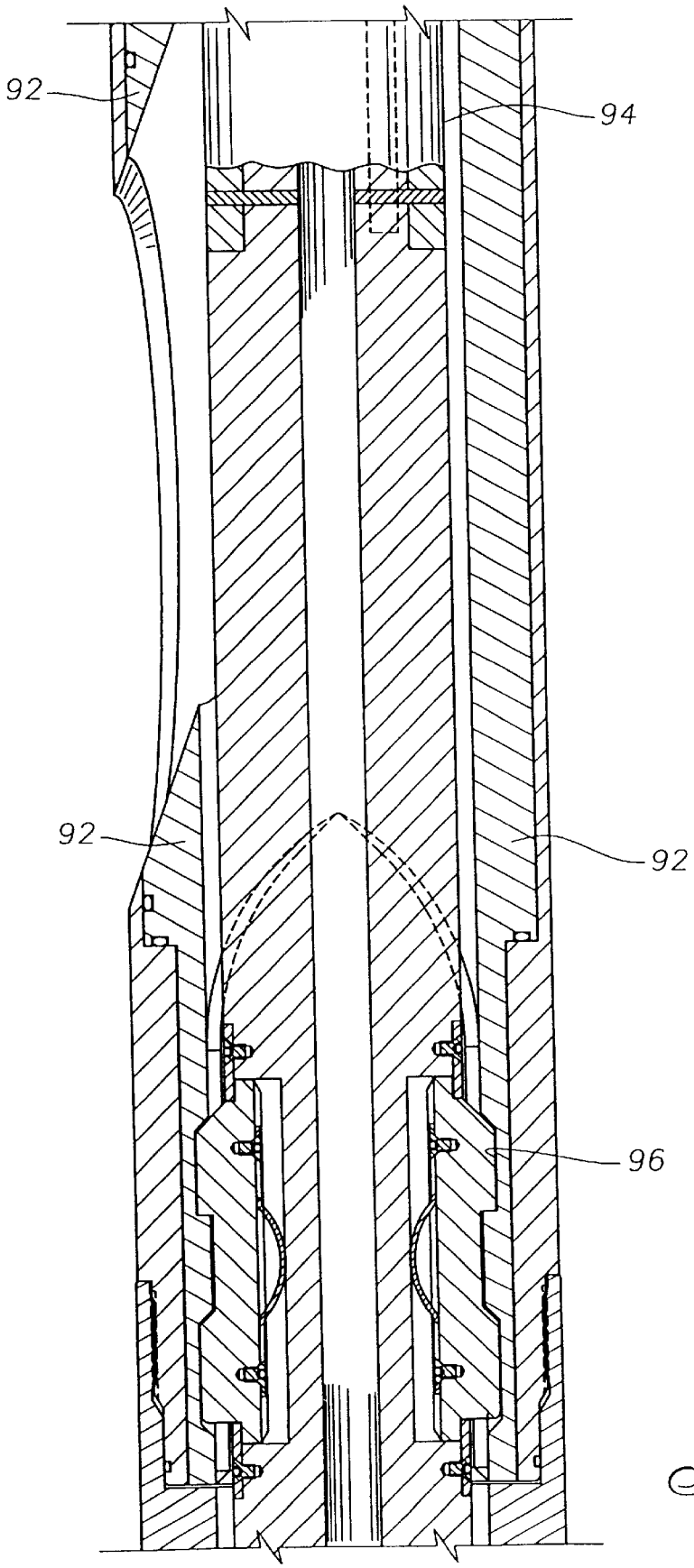
Figure 2F:
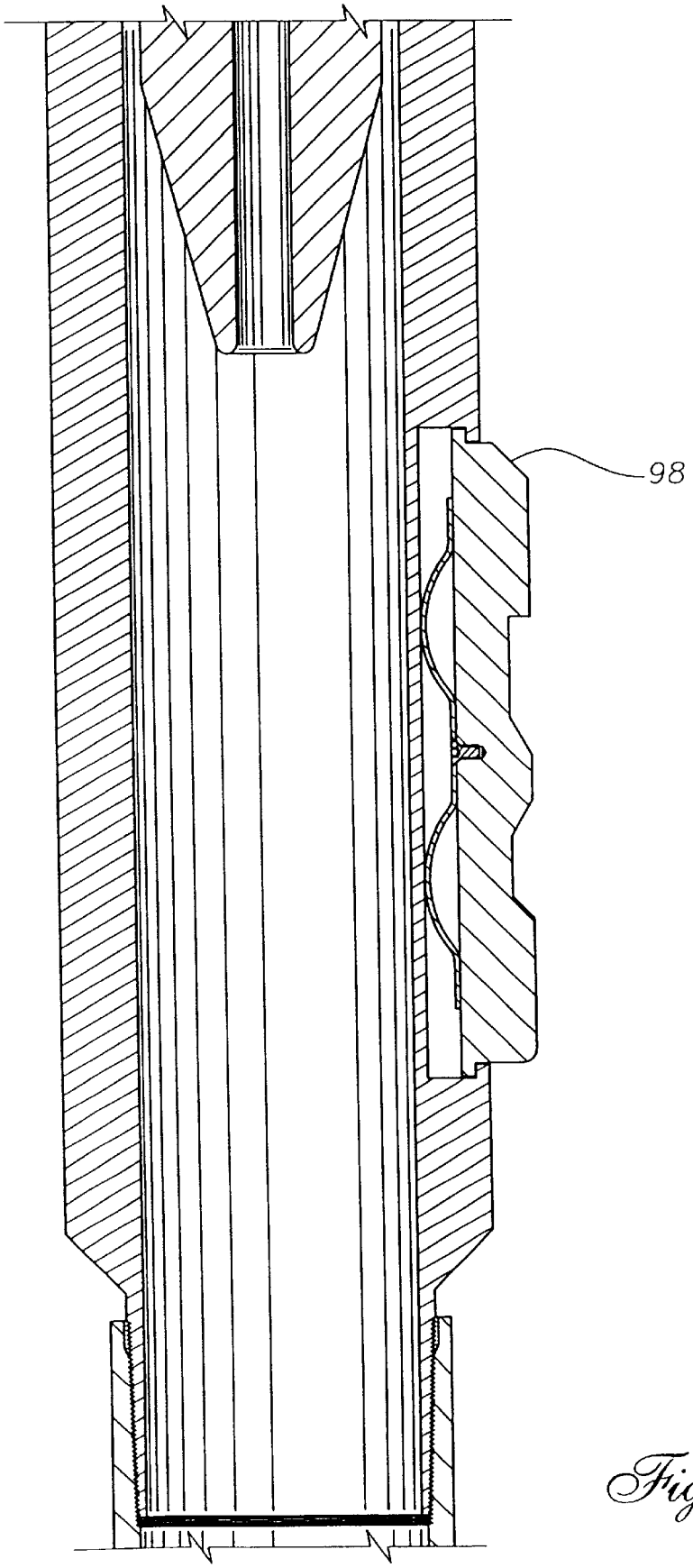
Figure 2G:
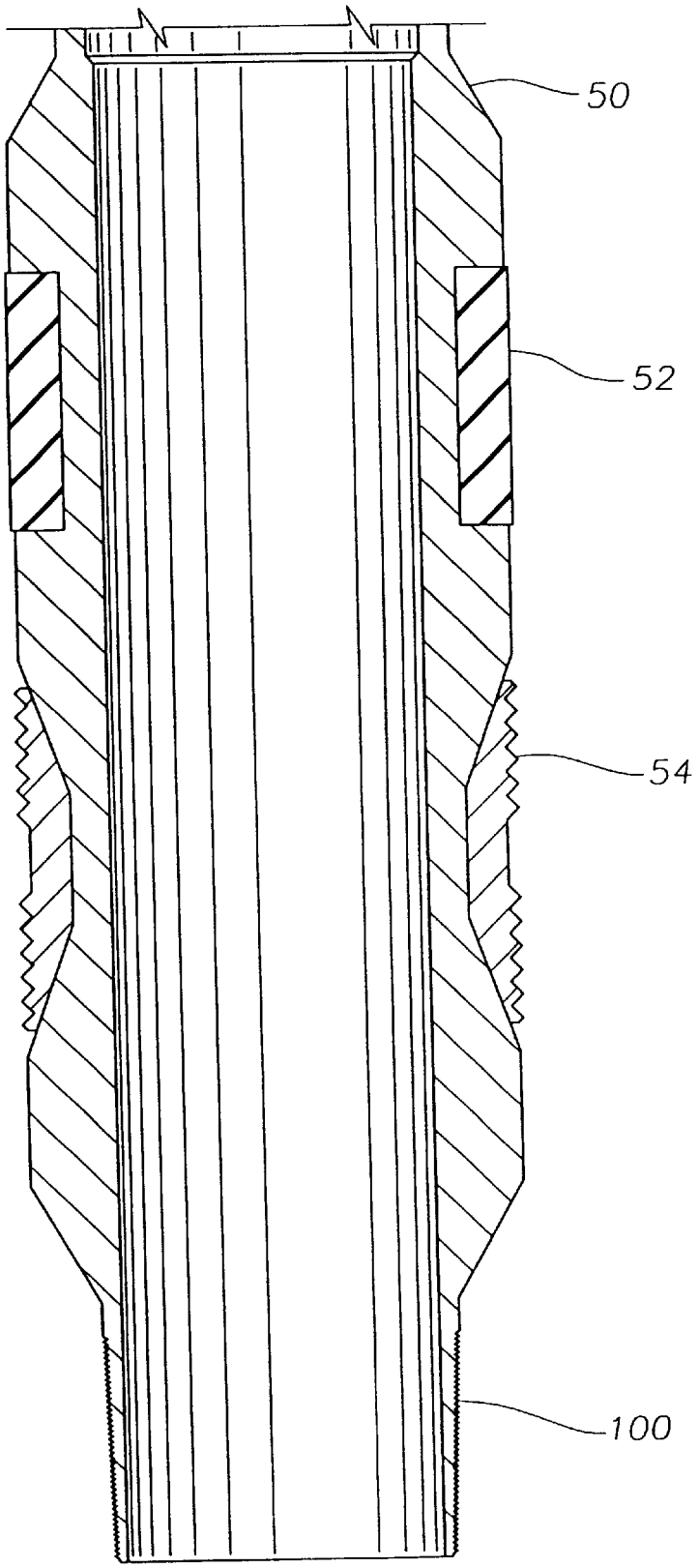
Figure 3A:
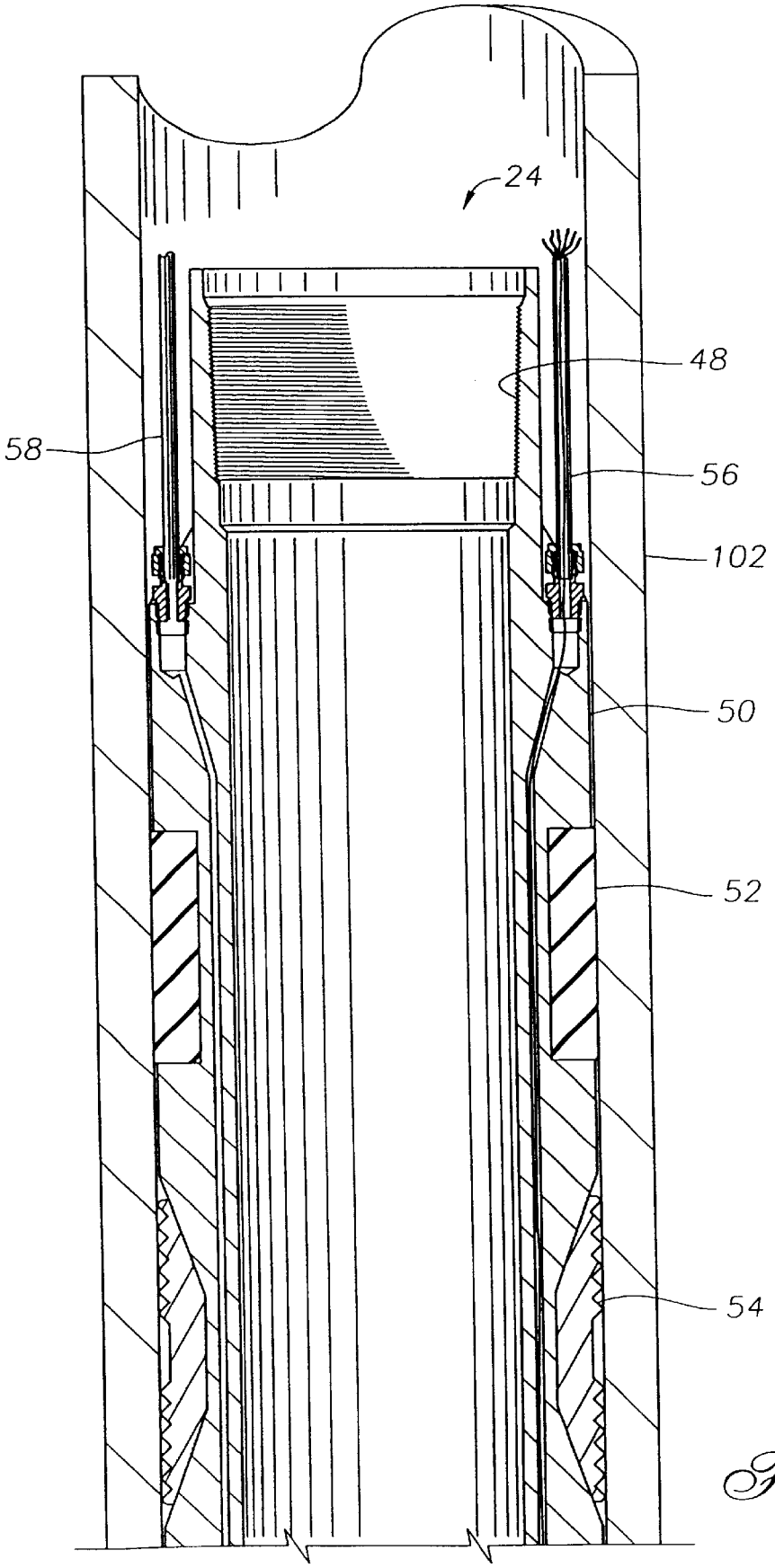
FIGS. 3 A–H taken together form a longitudinal section of the apparatus of FIGS. 2 A–G with a work string shown entering a lateral, and a longitudinal section of a selective orienting deflector tool located position.
Figure 3B:
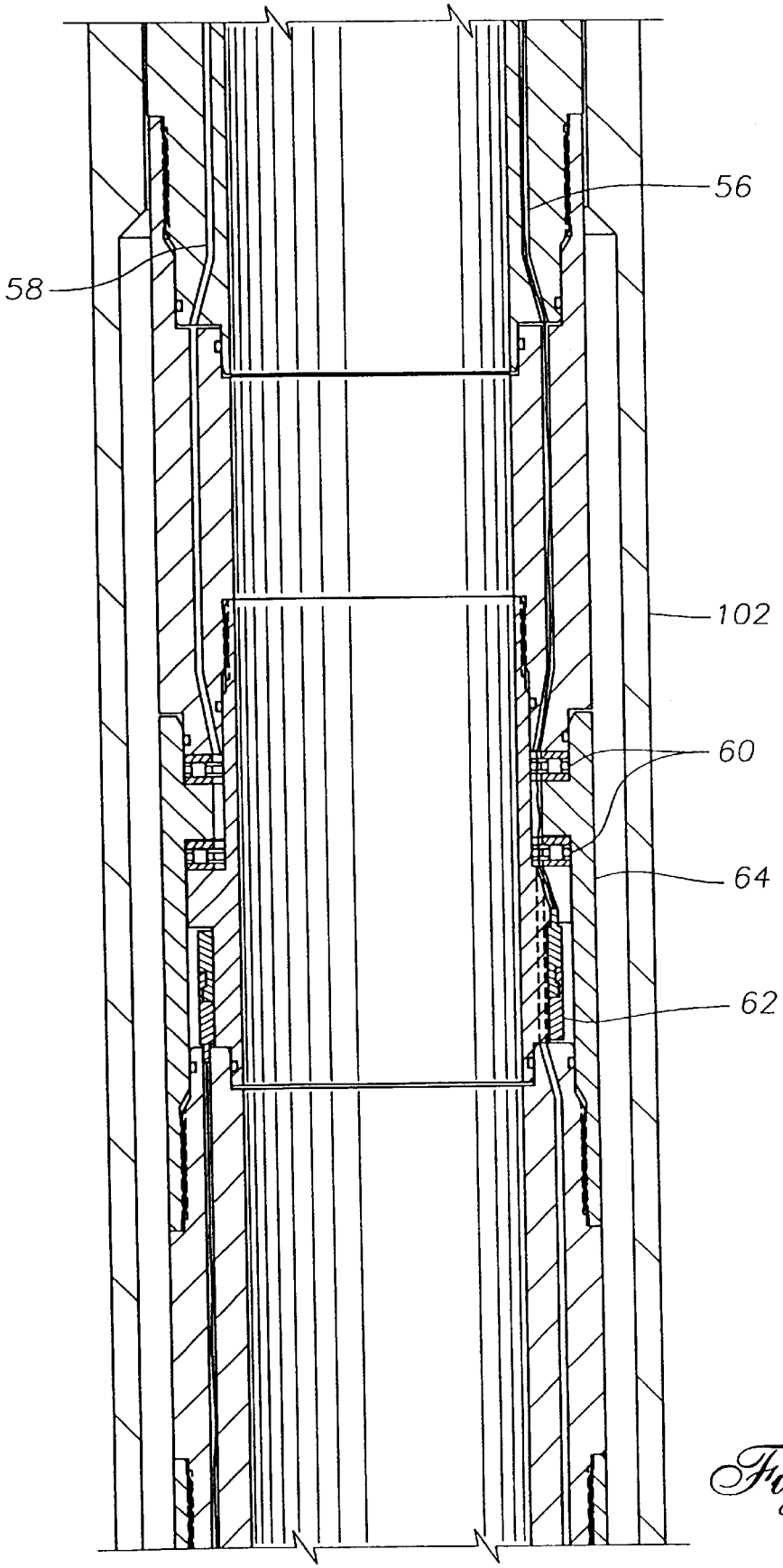
Figure 3C:
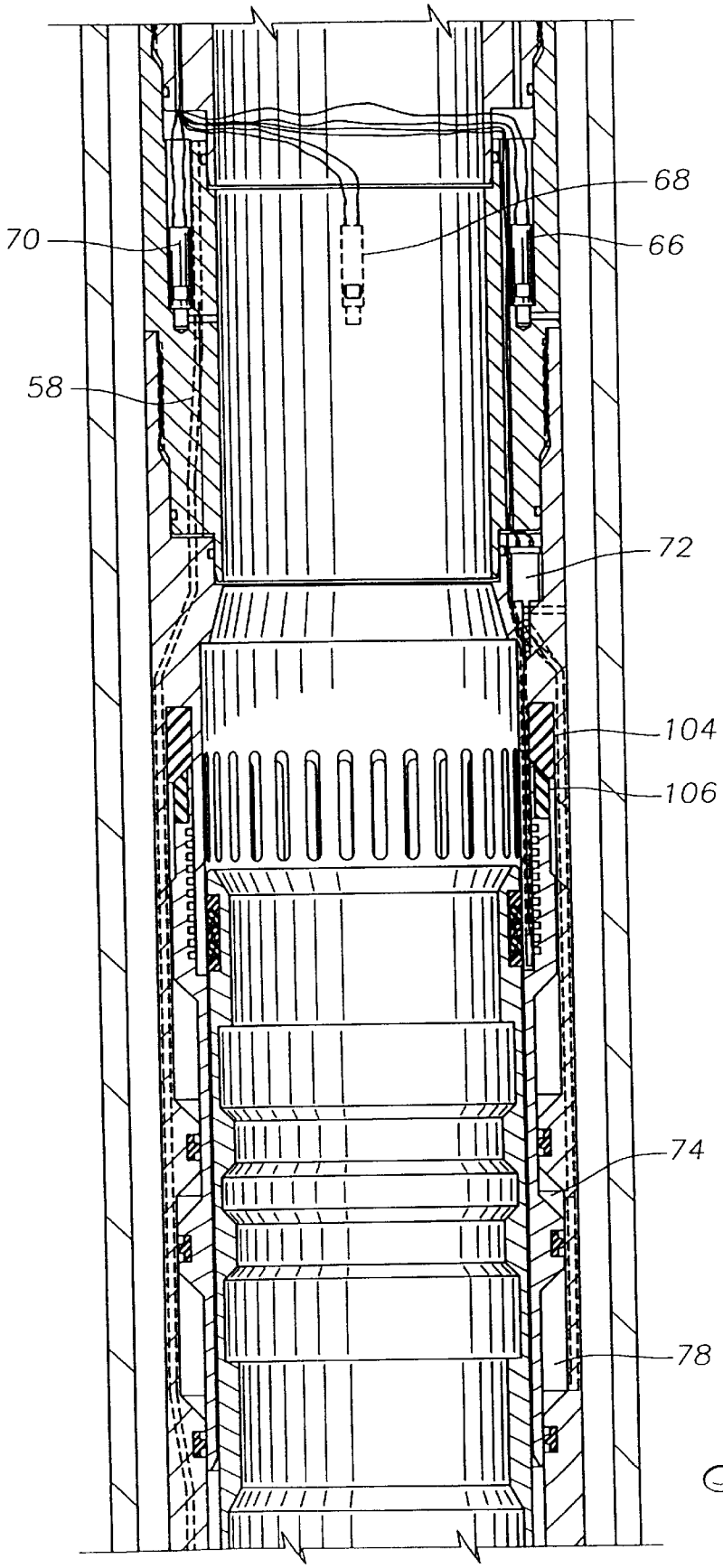
Figure 3D:
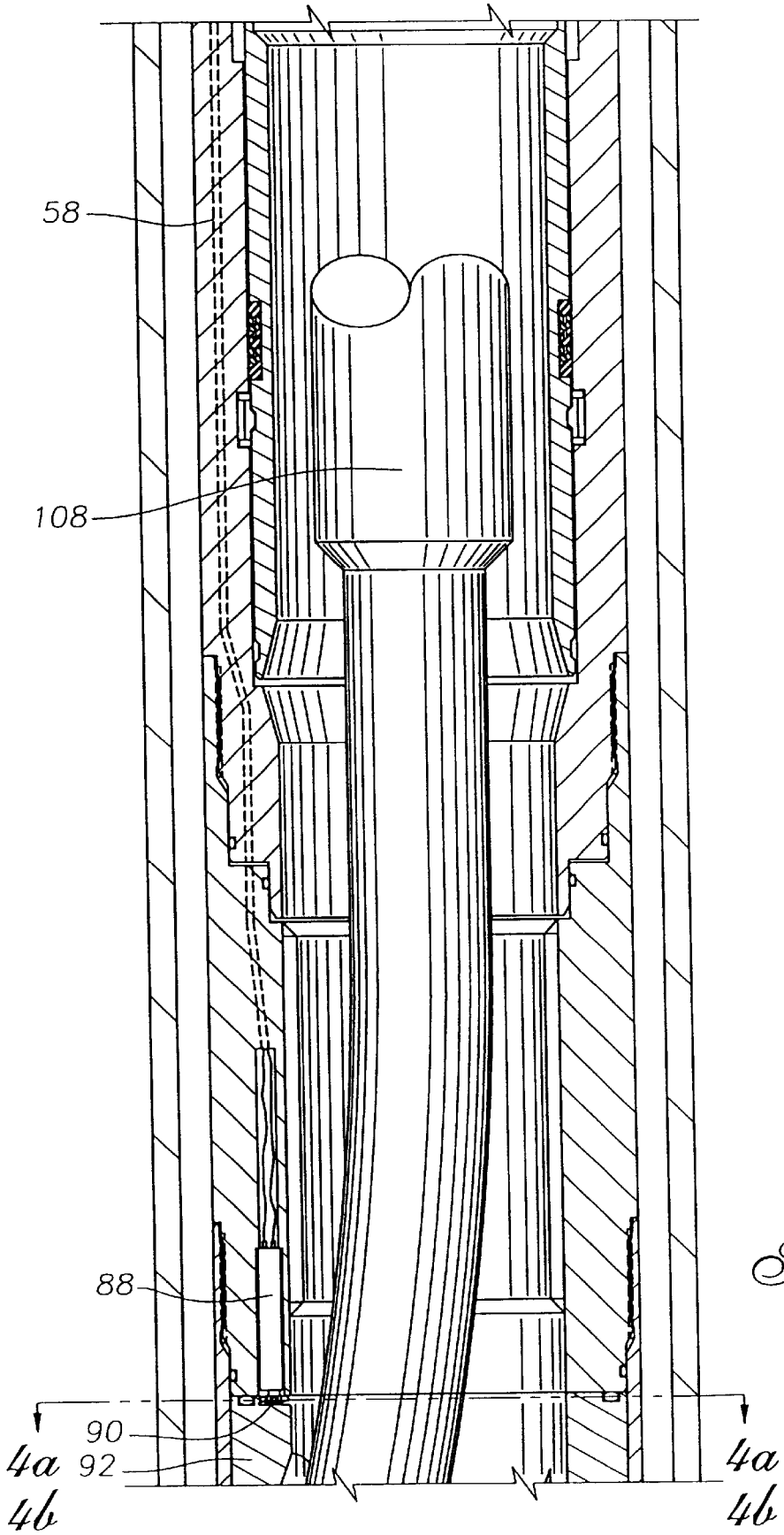
Figure 3E:
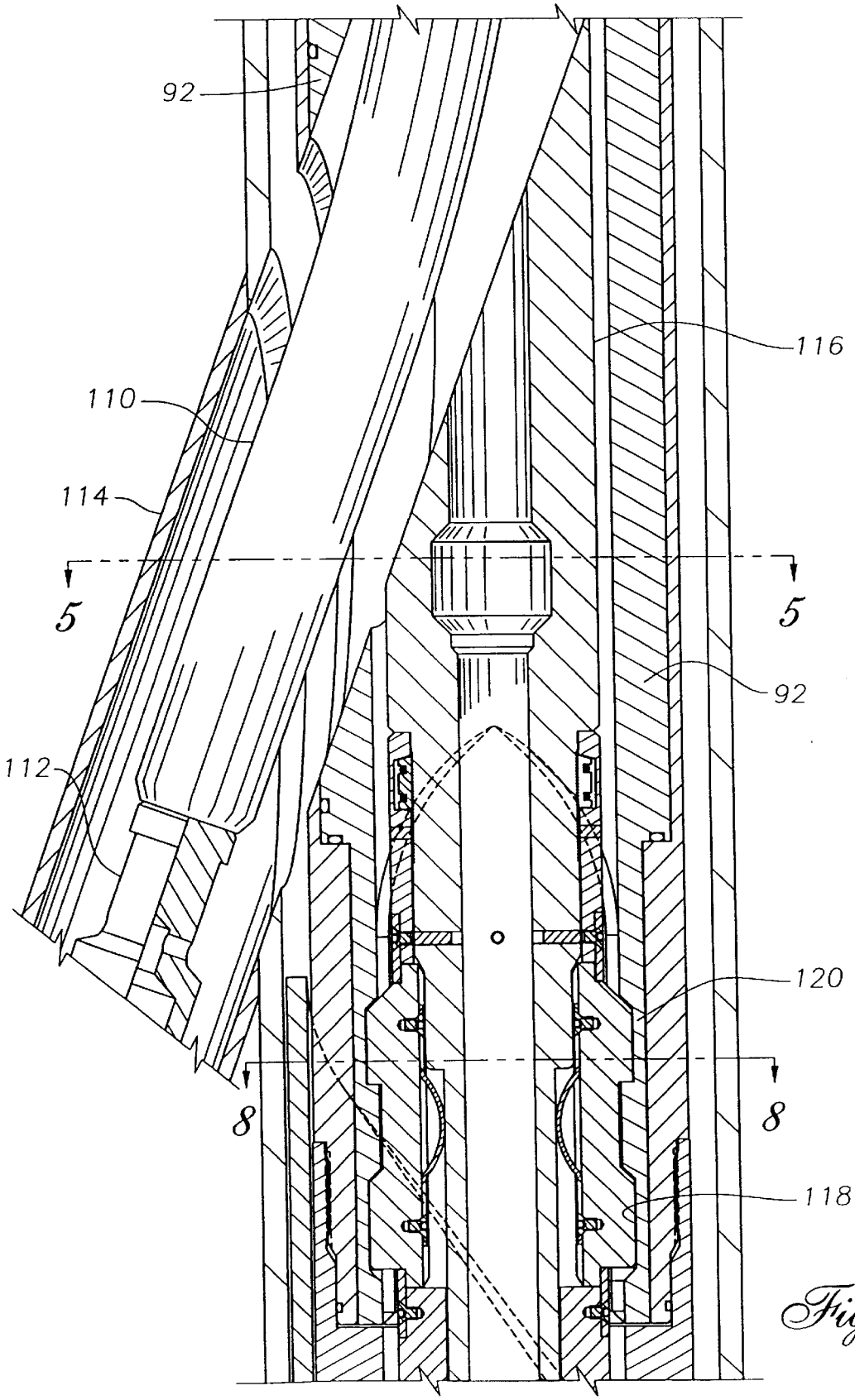
Figure 3F:
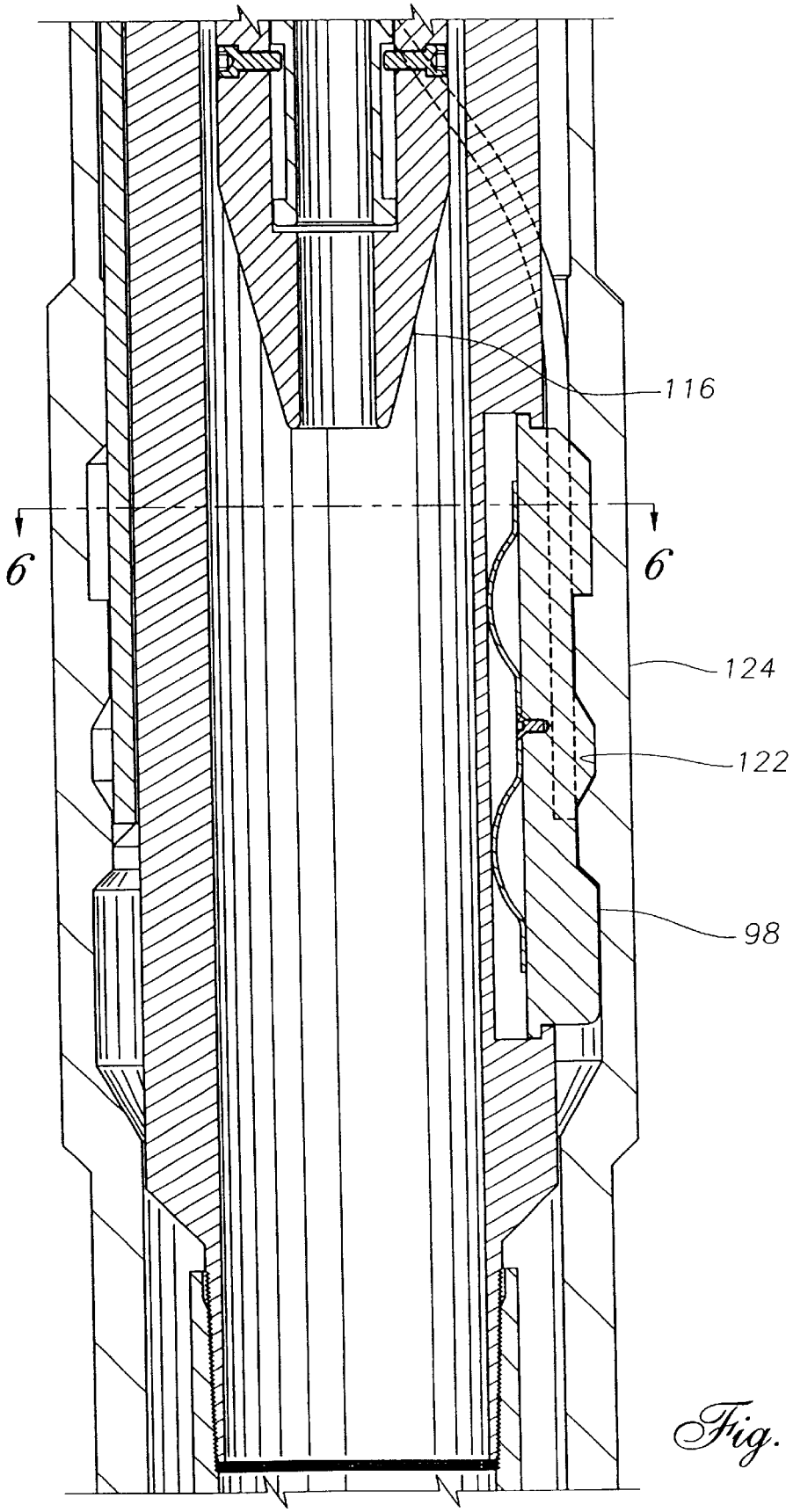
Figure 3G:
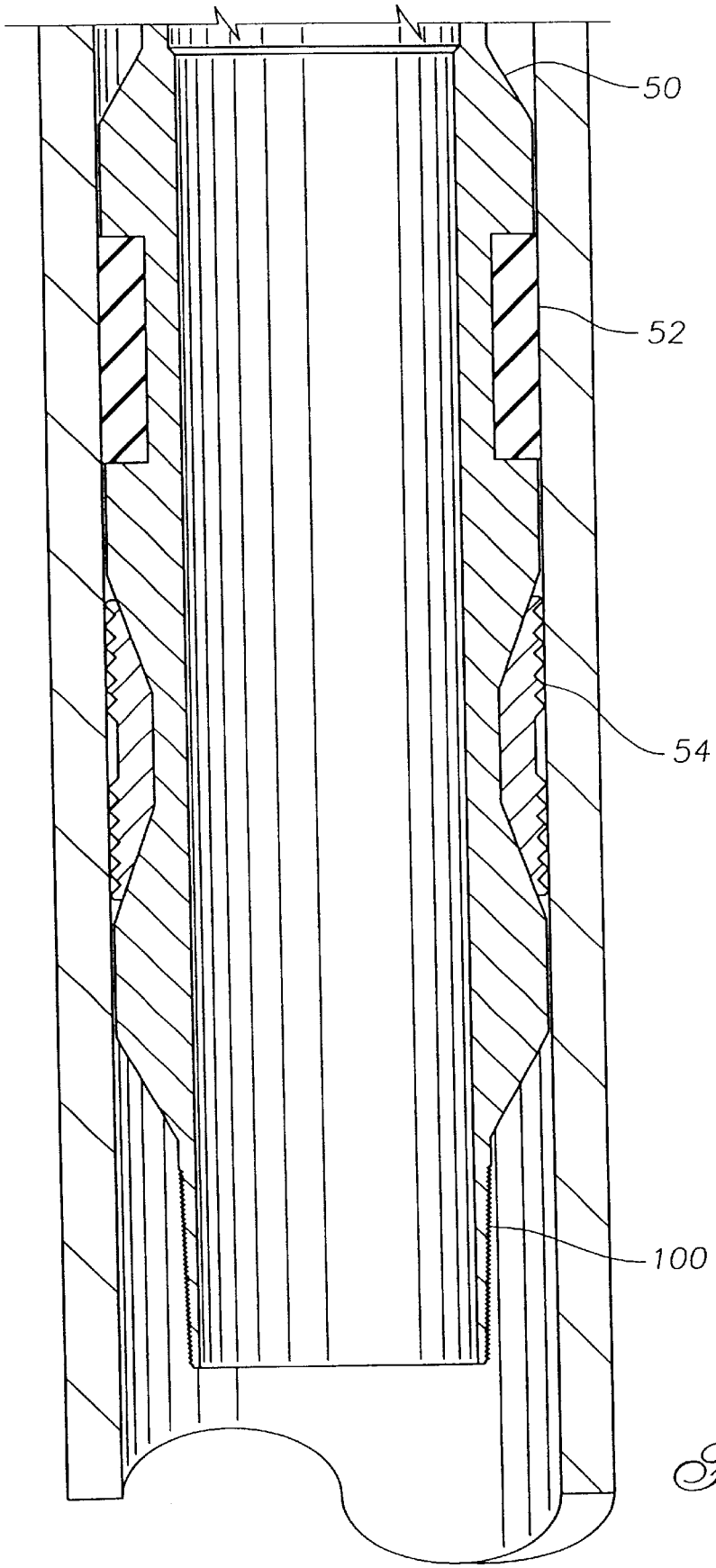
Figure 3H:
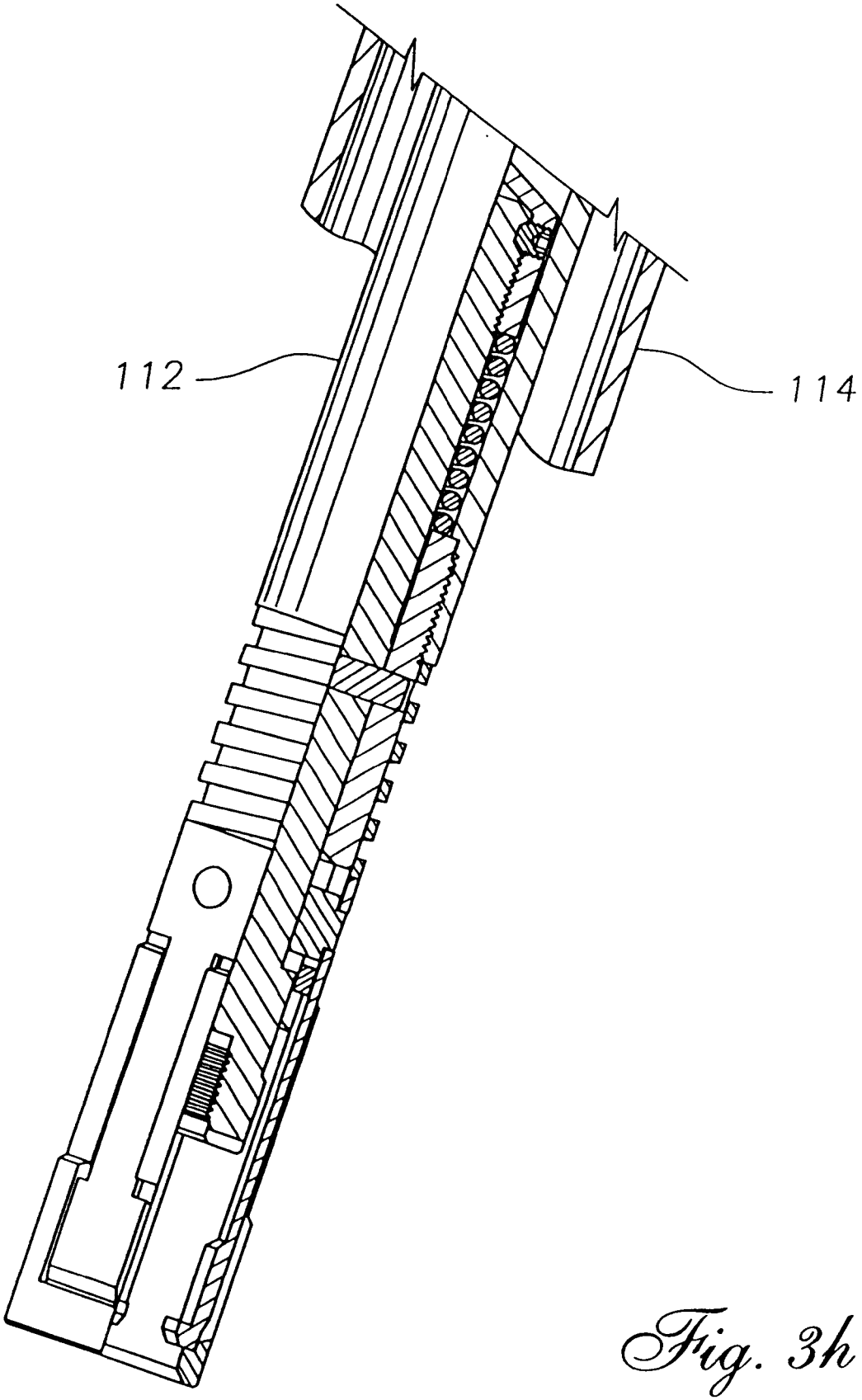

Referring now to FIG. 1, a substantially vertical wellbore 10 is shown with an upper lateral wellbore 12 and a lower lateral wellbore 14 drilled to intersect an upper producing zone 16 and an intermediate producing zone 18, as is well known to those skilled in the art of multilateral drilling. A production tubing 20 is suspended inside the vertical wellbore 10 for recovery of fluids to the earth's surface. Adjacent to an upper lateral well junction 22 is an upper fluid flow control apparatus 24 of the present invention while a lower fluid flow control apparatus 26 of the present invention is located adjacent to a lower lateral well junction 28. Each fluid flow control apparatus 24 and 26 are the same as or similar in configuration. In one preferred embodiment, the fluid flow control apparatus 24 and 26 generally comprises a generally cylindrical mandrel body having a central longitudinal bore extending therethrough, with threads or other connection devices on one end thereof for interconnection to the production tubing 20. A selectively operable lateral access door is provided in the mandrel body for alternately permitting and preventing a service tool from laterally exiting the body therethrough and into a lateral wellbore. In addition, in one preferred embodiment, a selectively operable flow control valve is provided in the body for regulating fluid flow between the outside of the body and the central bore.

In the fluid flow control apparatus 24 a lateral access door 30 comprises an opening in the body and a door or plug member. The door may be moved longitudinally or radially, and may be moved by one or more means, as will be described in more detail below. In FIG. 1 the door 30 is shown oriented toward its respective adjacent lateral wellbore. A pair of permanent or retrievable elastomeric packers 32 are provided on separate bodies that are connected by threads to the mandrel body or, preferably, are connected as part of the mandrel body. The packers 32 are used to isolate fluid flow between producing zones 16 and 18 and provide a fluidic seal thereby preventing co-mingling flow of produced fluids through a wellbore annulus 34. A lowermost packer 36 is provided to anchor the production tubing 20, and to isolate a lower most producing zone (not shown) from the producing zones 16 and 18 above. A communication conduit or cable or conduit 38 is shown extending from the fluid flow control apparatus 26, passing through the isolation packers 32, up to a surface control panel 40. A tubing plug 42, which is well known, may be used to block flow from the lower most producing zone (not shown) into the tubing 20.

A well with any multiple of producing zones can be completed in this fashion, and a large number of flow configurations can be attained with the apparatus of the present invention. For the purposes of discussion, all these possibilities will not be discussed, but remain within the spirit and scope of the present invention. In the configuration shown in FIG. 1, the production tubing 20 is plugged at the lower end by the tubing plug 42, the lower fluid flow control apparatus 26 has a flow control valve that is shown closed, and the upper fluid flow control apparatus 24 is shown with its flow control valve in the open position. This production configuration is managed by an operator standing on the surface at the control panel 40, and can be changed therewith by manipulation of the controls on that panel. In this production configuration, flow from all producing formations is blocked, except from the upper producing zone 16. Hydrocarbons 44 present therein will flow from the formation 16, through the upper lateral 12, into the annulus 34 of the vertical wellbore 10, into a set of ports 46 in the mandrel body and into the interior of the production tubing 20. From there, the produced hydrocarbons move to the surface.

Turning now to FIGS. 2 A–G, which, when taken together illustrate the fluid flow control apparatus 24. An upper connector 48 is provided on a generally cylindrical mandrel body 50 for sealable engagement with the production tubing 20. An elastomeric packing element 52 and a gripping device 54 are connected to the mandrel body 50. A first communication conduit 56, preferably, but not limited to electrical communication, and a second communication conduit 58, preferably, but not limited to hydraulic control communication, extend from the earth's surface into the mandrel 50. The first 56 and second 58 communication conduits communicate their respective signals to/from the earth's surface and into the mandrel 50 around a set of bearings 60 to slip joint 62. The electrical communication conduit or cable 56 connects at this location, while the hydraulic communication conduit 58 extends therepast. The bearings 60 reside in a rotating swivel joint 64, which allows the mandrel body 50 and its lateral access door 30 to be rotated relative to tubing 20, to ensure that the lateral access door 30 is properly aligned with the lateral wellbore. Further, the electrical communication conduit or cable 56 communicates with a first pressure transducer 66 to monitor annulus pressure, a temperature and pressure sensor 68 to monitor temperature and hydraulic pressure, and/or a second pressure transducer 70 to monitor tubing pressure. Signals from these transducers are communicated to the control panel 40 on the surface so operations personnel can make informed decisions about downhole conditions.

In this preferred embodiment, the electrical communication conduit or cable also communicates with a solenoid valve 72, which selectively controls the flow of hydraulic fluid from the hydraulic communication conduit 58 to an upper hydraulic chamber 74, across a moveable piston 76, to lower hydraulic chamber 78. The differential pressures in these two chambers 74 and 78 move the operating piston 76 and a sleeve extending therefrom in relation to an annularly openable port or orifice 80 in the mandrel body 50 to allow hydrocarbons to flow from the annulus 34 to the tubing 20. Further, the rate of fluid flow can be controlled by adjusting the relative position of the piston 76 through the use of a flow control position indicator 82, which provides the operator constant and instantaneous feedback as to the size of the opening selected.

In some instances, however, normal operation of the flow control valve may not be possible for any number of reasons. An alternate and redundant method of opening or closing the flow control valve and the annularly operable orifice 80 uses a coiled tubing deployed shifting tool 84 landed in a profile in the internal surface of the mandrel body 50. Weight applied to this shifting tool 84 is sufficient to move the flow control valve to either the open or closed positions as dictated by operational necessity, as can be understood by those skilled in the art.

The electrical communication conduit or cable 56 further communicates electrical power to a high torque rotary motor 88 which rotates a pinion gear 90 to rotate a lateral access plug member or door 92. This rotational force opens and closes the rotating lateral access door 92 should entry into the lateral wellbore be required. In some instances, however, normal operation of the rotating lateral access door 92 may not be possible for any number of reasons. An alternate, and redundant method of opening the rotating lateral access door 92 is also provided wherein a coiled tubing deployed rotary tool 94 is shown located in a lower profile 96 in the interior of the mandrel body 50. Weight applied to this rotary tool 94 is sufficient to rotate the rotating lateral access door 92 to either the open or closed positions as dictated by operational necessity, as would be well known to those skilled in the art.

When the fluid flow apparatus 24 and 26 are set within the wellbore the depth and azimuthal orientation is controlled by a spring loaded, selective orienting key 98 on the mandrel body 50 which interacts with an orienting sleeve within a casing nipple, which is well known to those skilled in the art. Isolation of the producing zone is assured by the second packing element 52, and the gripping device 54, both mounted on the mandrel body 50, where an integrally formed lower connector 100 for sealable engagement with the production tubing 20 resides.

Referring now to FIGS. 3 A–H, which, when taken together illustrate the upper fluid flow control apparatus 24, set and operating in a well casing 102. In this embodiment, an upper valve seat 104 on the mandrel 50 and a lower 106 valve seat on the piston 76 are shown sealably engaged, thereby blocking fluid flow. The lateral access door 92 is in the form of a plug member that is formed at an angle to facilitate movement of service tools into and out of the lateral. Once so opened, a coiled tubing 108, or other well known remediation tool, can be easily inserted in the lateral wellbore. For purposes of illustration, a flexible tubing member 110 is shown attached to the coiled tubing 108, which is in turn, attached to a pulling tool 112, that is being inserted in a cased lateral 114.

A selective orienting deflector tool 116 is shown set in a profile 118 formed in the interior surface of the upper fluid flow control apparatus 24. The deflector tool 116 is located, oriented, and held in position by a set of locking keys 120, which serves to direct any particular service tool inserted in the vertical wellbore 10, into the proper cased lateral 114.

The depth and azimuthal orientation of the assembly as hereinabove discussed is controlled by a spring loaded, selective orienting key 98, which sets in a casing profile 122 of a casing nipple 124. Isolation of the producing zone is assured by the second packing element 52, and the gripping device 54, both mounted on the central mandrel 50.

Figure 4A:
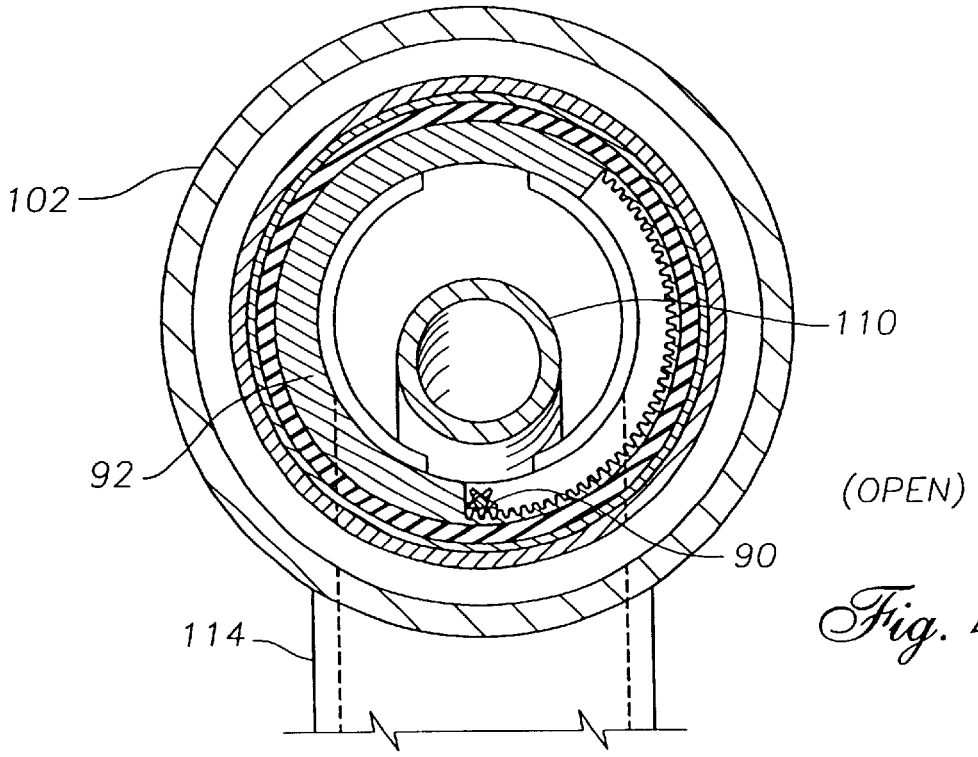
FIGS. 4 A–B illustrate two cross sections of FIG. 3 taken along line "4—4", without the service tools as shown therein.
Figure 4B:
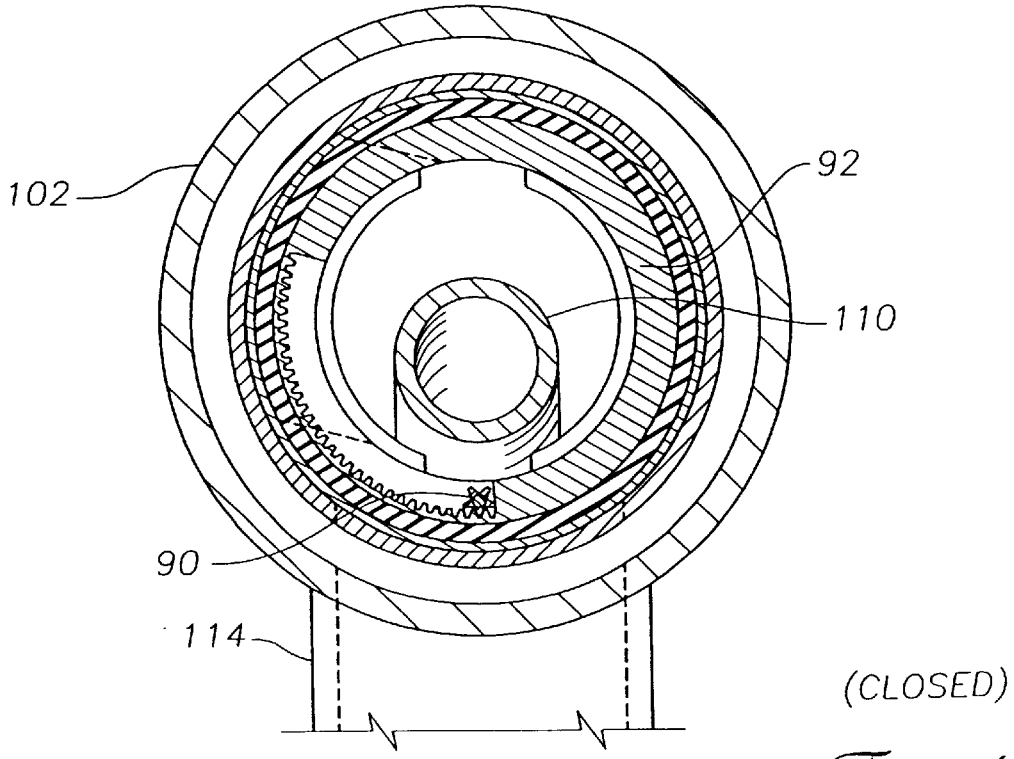
Figure 5:
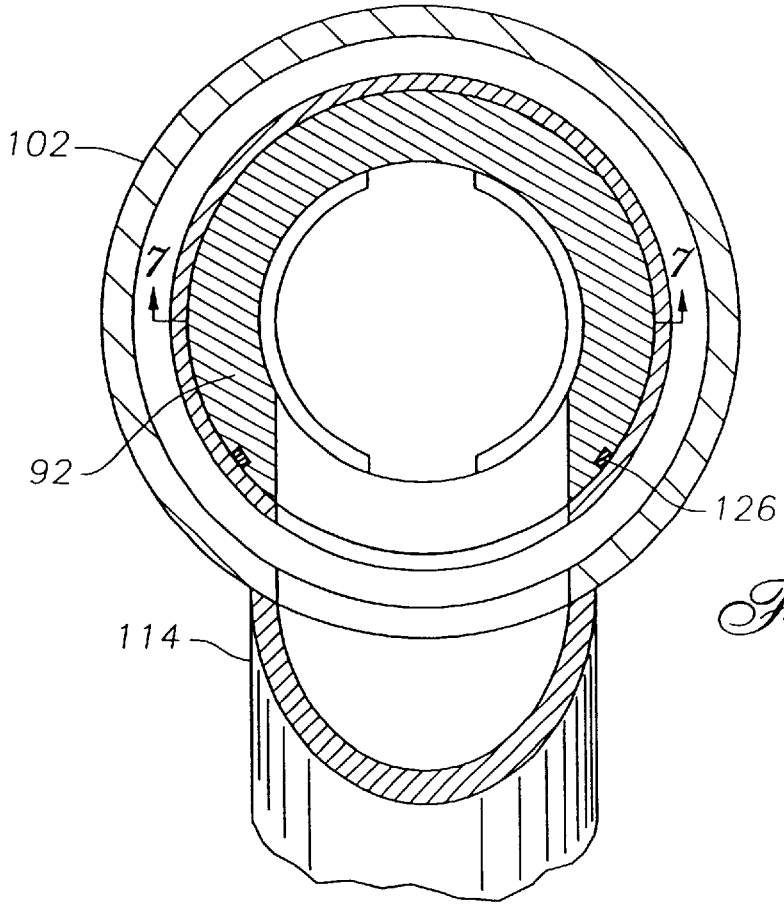
FIG. 5 illustrates a cross section of FIG. 3E taken along line "5—5", without the service tools as shown therein.
Figure 6:
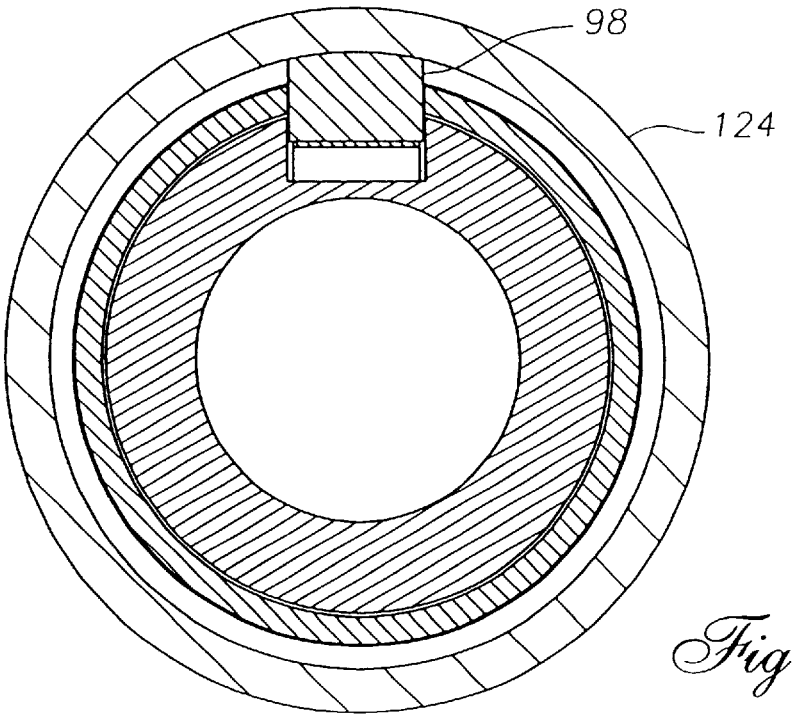
FIG. 6 illustrates a cross section of FIG. 3F taken along line "6—6", and depicts a locating, orienting and locking mechanism for anchoring the multilateral flow control system to the casing.

FIGS. 4 A–B is a cross section taken at "A—A" of FIGS. 3–D, shown without the flexible tubing member 110 in place, and represents a view of the top of the rotating lateral access door 92. FIGS. 4–A illustrates the relationship of the well casing 102, the cased lateral 114, the pinion gear 90, and the rotating lateral access door 92, shown in the open position. FIG. 4-B illustrates the relationship of the well casing 102, the cased lateral 114, the pinion gear 90, and the rotating lateral access door 92, shown in the closed position. Referring now to FIG. 5, which is a cross section taken at "5—5" of FIG. 3-E, and is shown without the flexible tubing member 110 in place, at a location at the center of the intersection of the cased lateral 114, and the well casing 102. This diagram shows the rotating lateral access door 92 in the open position, and a door seal 126. FIG. 6 is a cross section taken at "6—6" of FIG. 3-F and illustrates in cross section the manner in which the selective orienting key 98 engages the casing nipple 124 assuring the assembly described herein is located and oriented at the correct position in the well.

Figure 7:
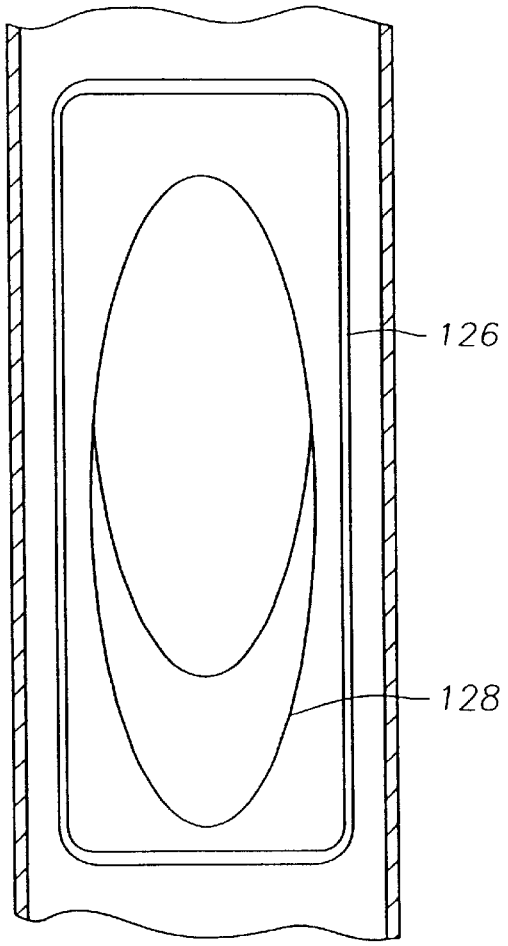
FIG. 7 illustrates a longitudinal section of FIG. 5 taken along line "7—7", and depicts an opening of the rotating lateral access door shown in the open position, and the sealing mechanism thereof.
Figure 8:
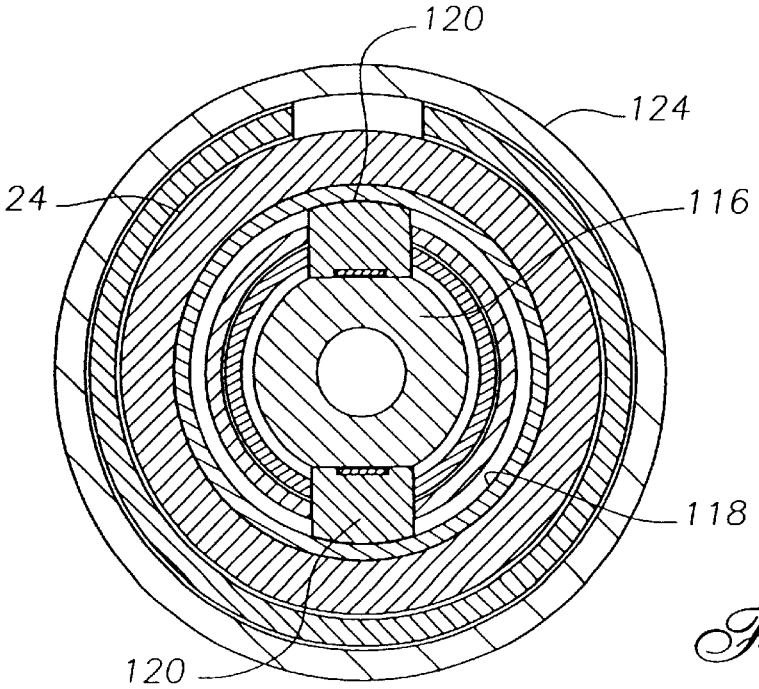
FIG. 8 illustrates a cross section of FIG. 3E taken along line "8—8", and depicts an orienting and locking mechanism for a selective orienting deflector tool and is located therein.

Turning now to FIG. 7, which is a longitudinal section taken at "7—7" of FIG. 5. This diagram primarily depicts the manner in which the door seal 126 seals around an elliptical opening 128 formed by the intersection of the cylinders formed by the cased lateral 114 and the rotating lateral access door 92. This view clearly shows the bevel used to ease movement of service tools into and out of the cased lateral 114. The final diagram, FIG. 8, is a cross section taken at "8—8" of FIG. 3-E. This shows the relationship of the casing nipple 124, the orienting deflector tool 116, the profile 118 formed in the interior surface of the upper fluid flow control apparatus 24, and how the locking keys 120 interact with the profile 118.

In a typical operation, the oil well production system of the present invention is utilized in wells with a plurality of producing formations which may be selectively produced. Referring once again to FIG. 1, if it were operationally desirable to produce from the upper producing zone 16 without co-mingling the flow with the hydrocarbons from the other formations; first a tubing plug 42 would need to be set in the tubing to isolate the lower producing zone (not shown). The operator standing at the control panel would then configure the control panel 40 to close the lower fluid flow control apparatus 26, and open the upper fluid flow control apparatus 24. Both rotating lateral access doors 30 would be configured closed. In this configuration, flow is blocked from both the intermediate producing zone 18, and the lower producing zone and hydrocarbons from the upper producing zone would enter the upper lateral 12, flow into the annulus 34, through the set of ports 46 on the upper fluid flow control apparatus 24, and into the production tubing 20, which then moves to the surface. Different flow regimes can be accomplished simply by altering the arrangement of the open and closed valves from the control panel, and moving the location of the tubing plug 42. The necessity of the tubing plug 42 can be eliminated by utilizing another flow control valve to meter flow from the lower formation as well.

When operational necessity dictates that one or more of the laterals requires re-entry, a simple operation is all that is necessary to gain access therein. For example, assume the upper lateral 12 is chosen for remediation. The operator at the remote control panel 40 shuts all flow control valves, assures that all rotating lateral access doors 30 are closed except the one adjacent the upper lateral 12, which would be opened. If the orienting deflector tool 116 is not installed, it would become necessary to install it at this time by any of several well known methods. In all probability, however, the deflector tool 116 would already be in place. Entry of the service tool in the lateral could then be accomplished, preferably by coiled tubing or a flexible tubing such as CO-FLEXIP brand pipe, because the production tubing 20 now has an opening oriented toward the lateral, and a tool is present to deflect tools running in the tubing into the desired lateral. Production may be easily resumed by configuring the flow control valves as before.

Another specific embodiment of the selectively operable flow control valve of the present invention is shown in FIGS. 9 through 16.

Figure 16:
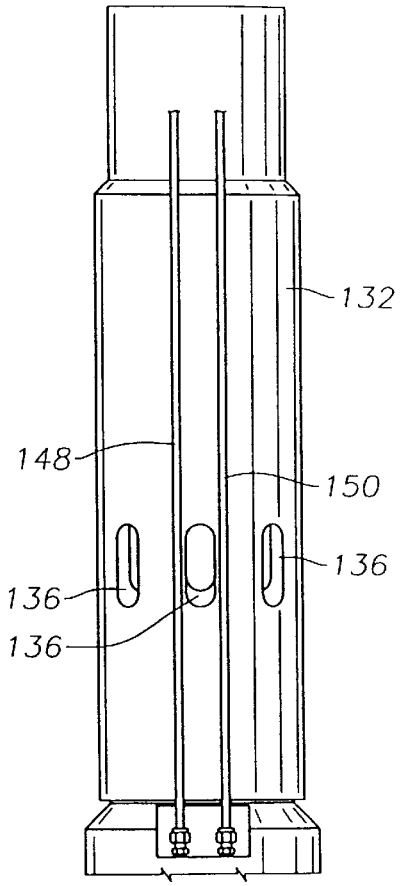
FIG. 16 illustrates a side view of an upper portion of the embodiment shown in FIGS. 9 A–D.

With reference to FIGS. 9 A–D, this specific embodiment of the selectively operable flow control valve of the present invention is identified generally by the reference numeral 130. Referring to FIG. 9A, the valve 130 includes a generally cylindrical body 132 having a central bore 134 extending therethrough, at least one flow port 136 through a sidewall thereof, and a first valve seat 138. The valve 130 further includes a sleeve member 140 that is disposed for longitudinal movement within the central bore 134 of the body 132. The sleeve member 140 may include at least one flow slot 142, and a second valve seat 144 for cooperable sealing engagement with the first valve seat 138 on the body 132. In this embodiment, as shown in FIG. 9B, a piston 146 may be connected to, or a part of, the sleeve 140, and may be sealably, slidably disposed within the central bore 134 of the body 132. In a specific embodiment, the piston 146 may be an annular piston or at least one rod piston. As best shown in FIG. 16, in this embodiment of the present invention, a first hydraulic conduit 148 and a second hydraulic conduit 150 are connected between a source of hydraulic fluid, such as at the earth's surface (not shown), and the valve body 132. The first hydraulic conduit 148 is in fluid communication with a first side 152 of the piston 146, and the second hydraulic conduit 150 is in fluid communication with a second side 154 of the piston 146 via a passageway 156 in the body 132.

Figure 9A:
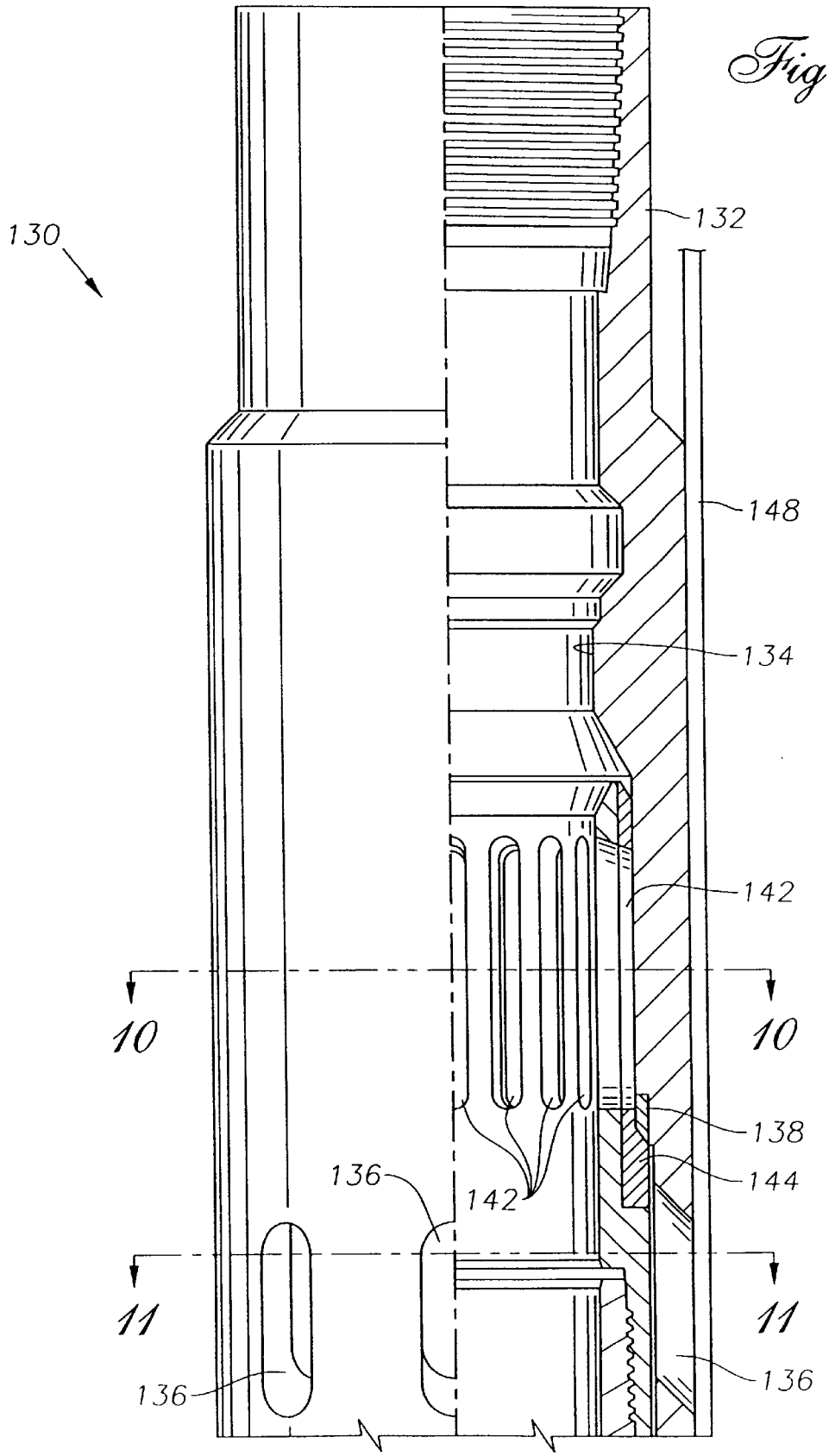
FIGS. 9 A–D taken together form a longitudinal section of one preferred embodiment of an apparatus for remote control of fluid flow within a well.

Longitudinal movement of the sleeve 140 within the central bore 134 of the body 132 is controlled by application and/or removal of pressurized fluid from the first and second hydraulic conduits 148 and 150 to and from the piston 146. Specifically, removal of pressurized fluid from the first side 152 of the piston 146 by bleeding pressurized fluid from the first hydraulic conduit 148, and/or application of pressurized fluid to the second side 154 of the piston 146 by applying pressurized fluid from the second hydraulic conduit 150, results in upward movement of the sleeve member 140. Similarly, removal of pressurized fluid from the second side 154 of the piston 146 by bleeding pressurized fluid from the second hydraulic conduit 150, and/or application of pressurized fluid to the first side 152 of the piston 146 by applying pressurized fluid from the first hydraulic conduit 148, results in downward movement of the sleeve member 140. As best shown in FIG. 9A, when the sleeve member 140 is biased in its maximum upward position, the first and second valve seats 138 and 144 are cooperably engaged to restrict fluid flow through the at least one flow port 136 in the valve body 132. But when the sleeve member 140 is moved downwardly so as to disengage the first and second valve seats 138 and 144, fluid flow is permitted through the at least one flow port 136 in the valve body 132, and through the at least one flow slot 142 in the sleeve member 140.

Figure 9B:
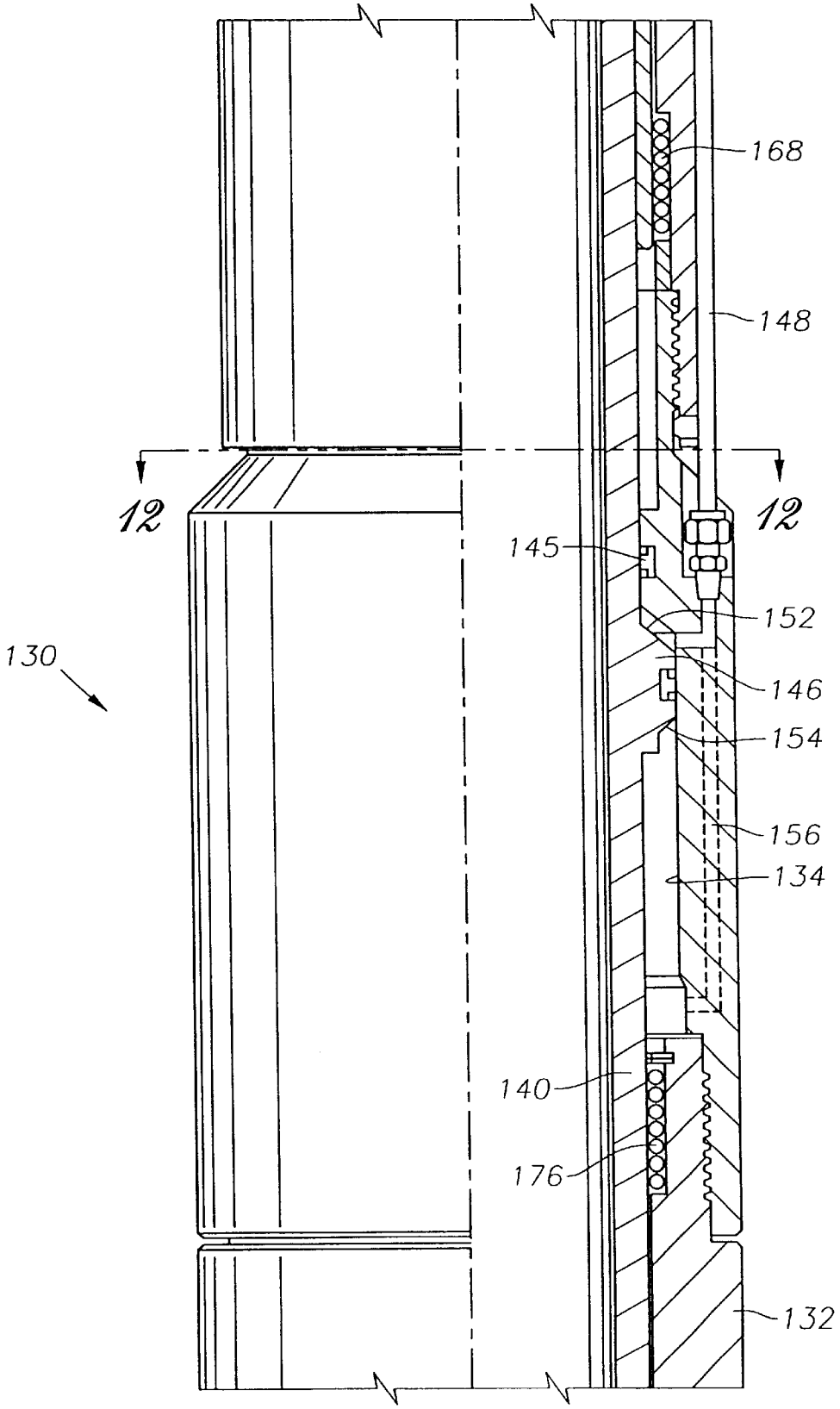
Figure 9C:
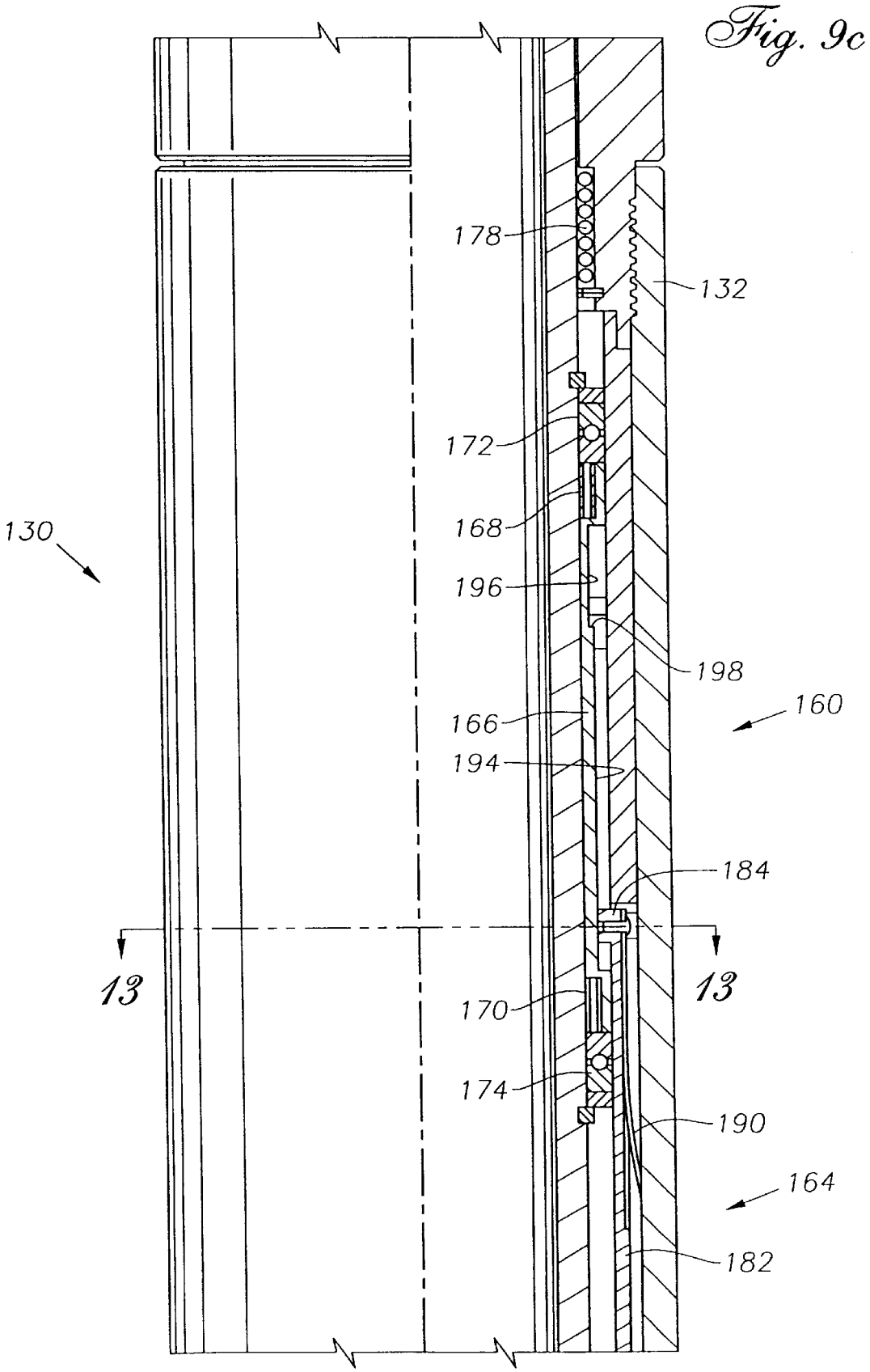

The valve 130 may be provided with a position holder to enable an operator at the earth's surface to remotely locate and maintain the sleeve member 140 in a plurality of discrete positions, thereby providing the operator with the ability to remotely regulate the rate of fluid flow through the at least one flow port 136 in the valve body, and/or through the at least one flow slot 142 in the sleeve member 140. The position holder may be provided in a variety of configurations. In a specific embodiment, as shown in FIGS. 9C–9D and 13–15, the position holder may include a cammed indexer 160 having a recessed profile 162 (FIG. 15), and be adapted so that a retaining member 164 (FIGS. 9C–9D) may be biased into cooperable engagement with the recessed profile 162, as will be more fully explained below. In a specific embodiment, one of the position holder and the retaining member may be connected to the sleeve member 140, and the other of the position holder and the retaining member may be connected to the valve body 132. In a specific embodiment, the recessed profile 162 may be formed in the sleeve member 140, or it may be formed in an indexing cylinder 166 disposed about the sleeve member 140 (FIG. 9C). In this embodiment, the indexing cylinder 166 and the sleeve member 140 are fixed to each other so as to prevent longitudinal movement relative to each other. As to relative rotatable movement between the two, however, the indexing cylinder 166 and sleeve member 140 may be fixed so as to prevent relative rotatable movement between the two, or the indexing cylinder 166 may be slidably disposed about the sleeve member 140 so as to permit relative rotatable movement. In the specific embodiment shown in FIGS. 9C and 9D, in which the recessed profile 162 is formed in the indexing cylinder 166, the indexing cylinder 166 is disposed for rotatable movement relative to the sleeve member 140, as per roller bearings 168 and 170, and ball bearings 172 and 174 (see FIG. 9C). The valve body 132 may include linear bearings 176–180 (FIGS. 9B–9D) to facilitate axial movement of the sleeve member 140 within the central bore 134.

Figure 9D:
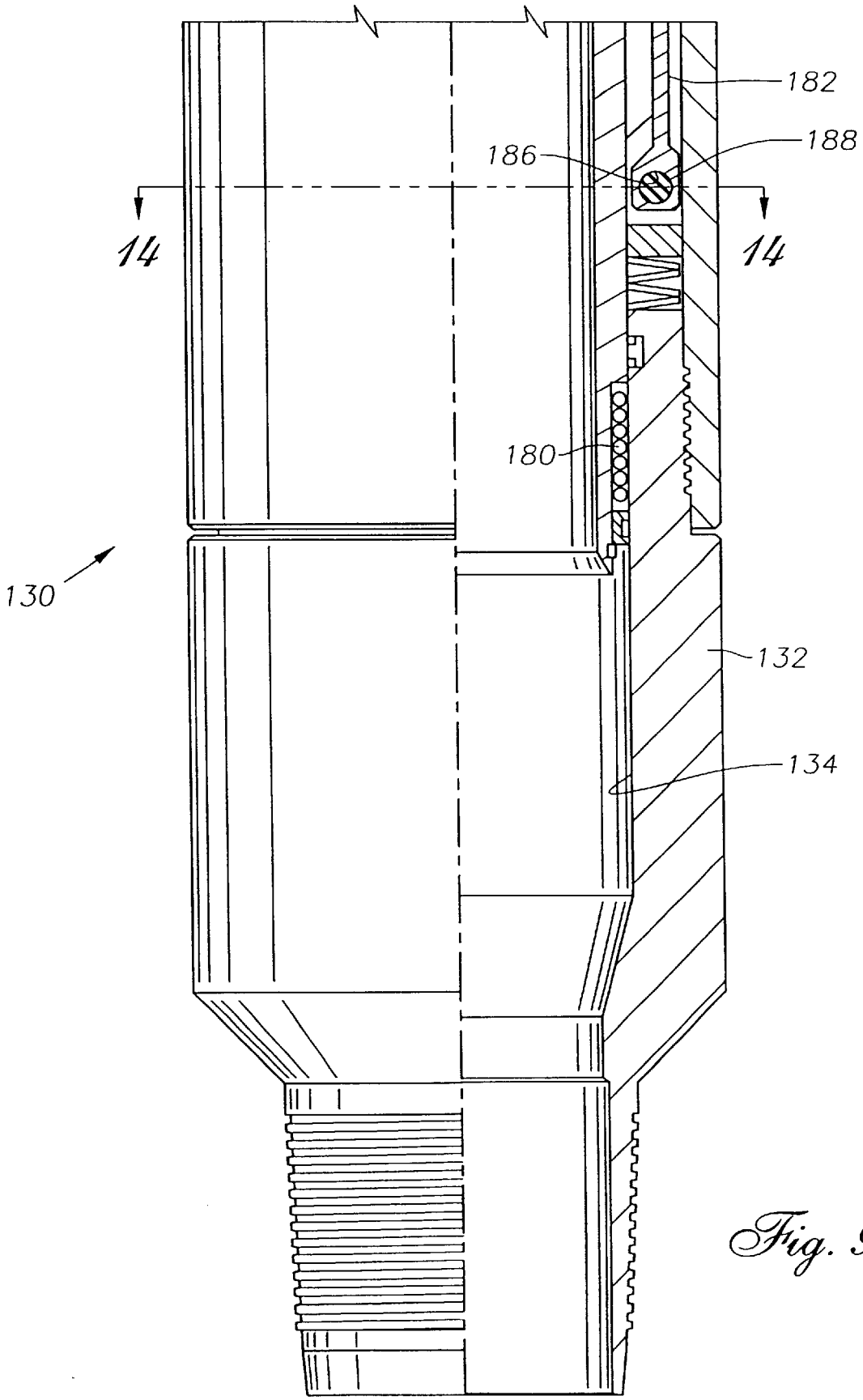
Figure 10:
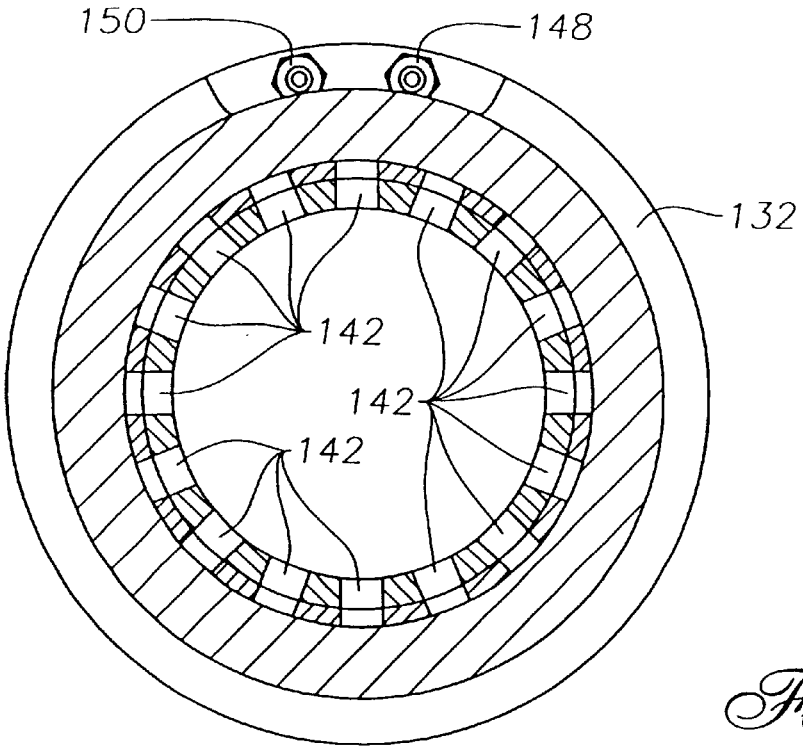
FIG. 10 illustrates a cross section of FIG. 9A taken along line "10—10".
Figure 11:
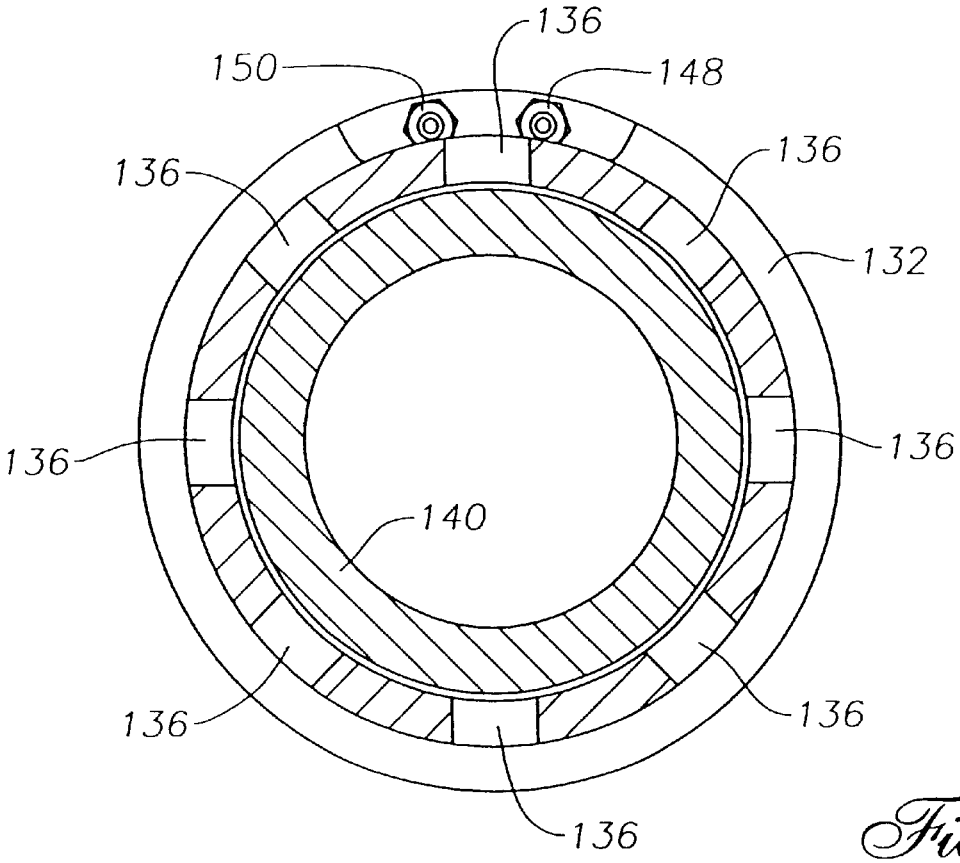
FIG. 11 illustrates a cross section of FIG. 9A taken along line "11—11".
Figure 12:
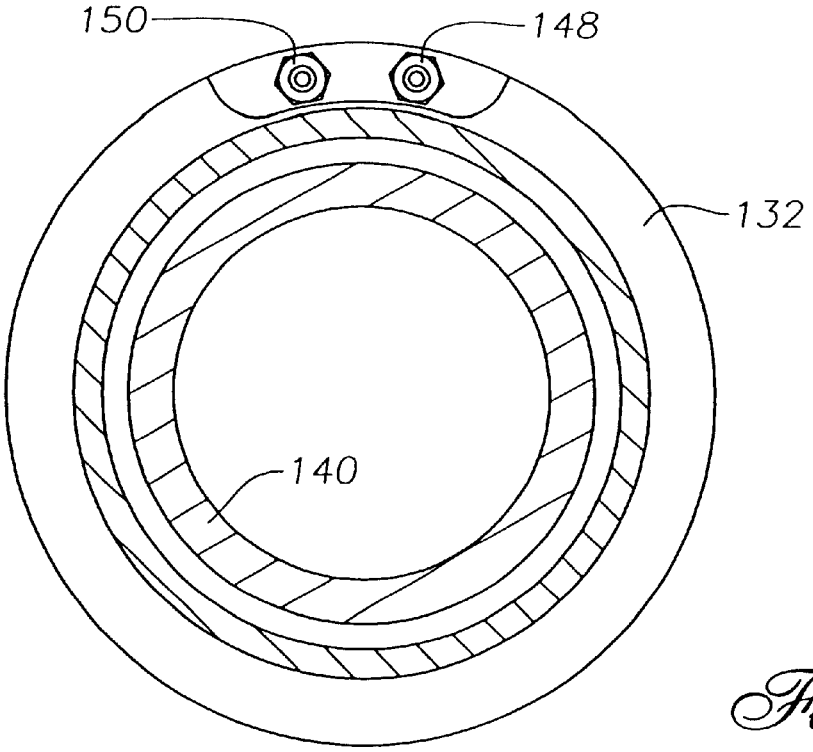
FIG. 12 illustrates a cross section of FIG. 9B taken along line "12—12".
Figure 13:
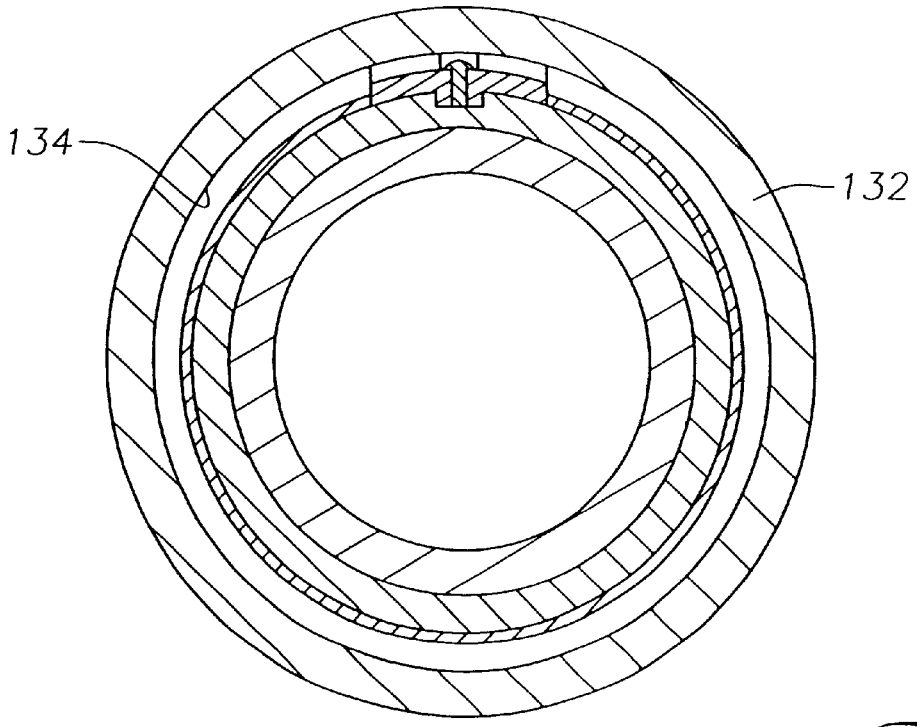
FIG. 13 illustrates a cross section of FIG. 9C taken along line "13—13".
Figure 14:
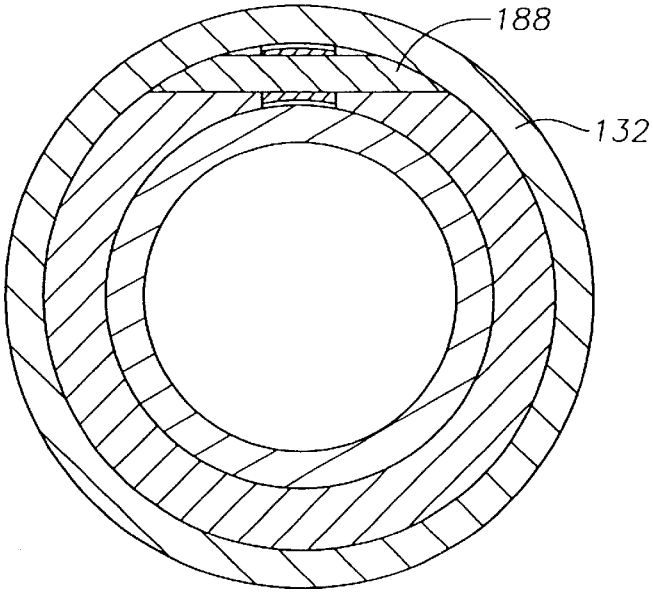
FIG. 14 illustrates a cross section of FIG. 9D taken along line "14—14".

In a specific embodiment, with reference to FIGS. 9C and 9D, the retaining member 164 may include an elongate body 182 having a cam finger 184 at a distal end thereof (see also FIG. 13) and a hinge bore 186 at a proximal end thereof (see also FIG. 14). A hinge pin 188 is disposed within the hinge bore 186 and connected to the valve body 132, as shown in FIGS. 9D and 14. In this manner, the retaining member 164 may be hingedly connected to the valve body 132. As best shown in FIG. 9C, a biasing member 190, such as a spring, may be provided to bias the retaining member 164 into engagement with the recessed profile 162. Other embodiments of the retaining member 164 are within the scope of the present invention. For example, the retaining member 164 may be a spring-loaded detent pin (not shown) that may be attached to the valve body 132.

Figure 15:
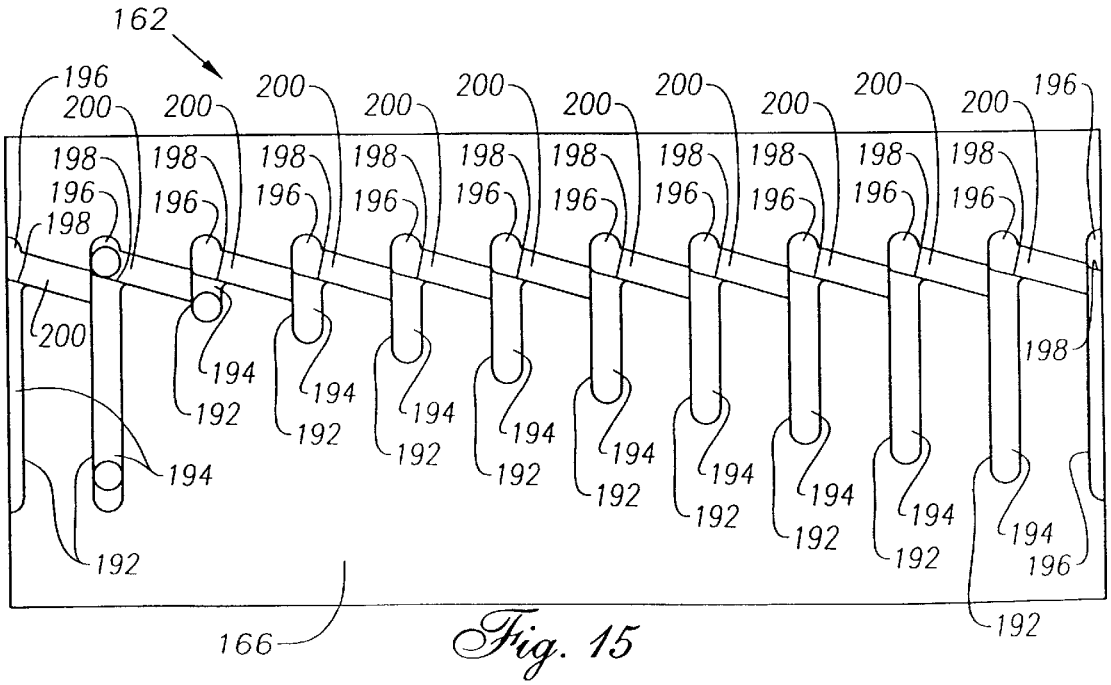
FIG. 15 illustrates a planar projection of an outer cylindrical surface of a position holder shown in FIG. 9C.

The recessed profile 162 will now be described, primarily with reference to FIG. 15, which illustrates a planar projection of the recessed profile 162 in the indexing cylinder 166. As shown in FIG. 15, the recessed profile 162 preferably includes a plurality of axial slots 192 of varying length disposed circumferentially around the indexing cylinder 166, in substantially parallel relationship, each of which are adapted to selectively receive the cam finger 184 on the retaining member 164. While the specific embodiment shown includes eleven axial slots 192, this number should not be taken as a limitation. Rather, it should be understood that the present invention encompasses a cammed indexer 160 having any number of axial slots 192. Each axial slot 192 includes a lower portion 194 and an upper portion 196. The upper portion 196 is recessed, or deeper, relative to the lower portion 194, and an inclined shoulder 198 separates the lower and upper portions 194 and 196. An upwardly ramped slot 200 leads from the upper portion 196 of each axial slot 192 to the elevated lower portion 194 of an immediately neighboring axial slot 192, with the inclined shoulder 198 defining the lower wall of each upwardly ramped slot 200.

In operation, the pressure in the second hydraulic conduit 150 is preferably normally greater than the pressure in the first hydraulic conduit 148 such that the sleeve member 140 is normally biased upwardly, so that the cam finger 184 of the retaining member 164 is positioned against the bottom of the lower portion 194 of one of the axial slots 192. When it is desired to change the position of the sleeve member 140, however, the pressure in the first hydraulic conduit 148 should momentarily be greater than the pressure in the second hydraulic conduit 150 for a period long enough to shift the cam finger 184 into engagement with the recessed upper portion 196 of the axial slot 192. Then the pressure differential between the first and second hydraulic control lines 148 and 150 should be changed so that the pressure in the second control line 150 is greater than the pressure in the first control line 148 so as to move the sleeve member 140 upwardly, thereby causing the cam finger 184 to engage the inclined shoulder 198 and move up the upwardly ramped slot 200 and into the lower portion 194 of the immediately neighboring axial slot 192 having a different length. It is noted that, in the specific embodiment shown, the indexing cylinder 166 will rotate relative to the retaining member 164, which is hingedly secured to the valve body 132. By changing the relative pressure between the first and second hydraulic control lines 148 and 150, the cam finger 184 may be moved into the axial slot 192 having the desired length corresponding to the desired position of the sleeve member 140. This enables an operator at the earth's surface to shift the sleeve member 140 into a plurality of discrete positions and control the distance between the first and second valve seats 138 and 144 (FIG. 9A), and thereby regulate fluid flow through the at least one flow port 136 in the valve body 132.

It is noted that, when the valve 130 is positioned within a well (not shown), the sleeve member 140 is exposed to annulus pressure through the at least one flow port 136 in the valve body 132. In a specific embodiment, the valve 130 may be designed such that the annulus pressure imparts an upward force to the sleeve member 140 to assist in maintaining it in its closed, or sealed, position. For example, this may be accomplished by making the outer diameter of the sleeve member 140 adjacent the interface of the first and second valve seats 138 and 144 (FIG. 9A) greater than the outer diameter of the sleeve member at some point below the at least one flow port 136, such as at dynamic seal 145 (FIG. 9B). This difference in outer diameters at these sealing points will result in the annulus pressure acting to force the sleeve member 140 upwardly when the first and second valve seats 138 and 144 are in contact.

Another specific embodiment of the selectively operable flow control valve of the present invention is shown in FIGS. 17 through 23.

With reference to FIGS. 17 A–E, this specific embodiment of the selectively operable flow control valve of the present invention is identified generally by the reference numeral 202. Referring to FIG. 17A, the valve 202 includes a generally cylindrical body 204 having a central bore 206 extending therethrough, at least one flow port 208 through a sidewall thereof, and a first valve seat 210. In a specific embodiment, as shown in FIG. 17B, the first valve seat 210 may be slidably disposed within the central bore 206, and movable between a first, or uncompressed, position (not shown), and a second, or compressed, position, which is the position illustrated in FIG. 17B. The body 204 may include a downstop shoulder 209 against which first valve seat 210 abuts when in its first, or uncompressed, position (not shown). In this specific embodiment, the valve 202 may further include a biasing mechanism, such as a wave spring 205, disposed within the central bore 206 and contained between the slidably-disposed first valve seat 210 and a shoulder 207 on the valve body 204. The manner in which the wave spring 205 cooperates with the first valve seat 210 will be explained below. The valve 202 further includes a sleeve member 212 (FIGS. 17B and 17C) that is disposed for longitudinal movement within the central bore 206 of the body 204. The sleeve member 212 may include at least one flow slot 214, and a second valve seat 216 for cooperable sealing engagement with the first valve seat 210 on the body 204. As shown in FIG. 17C, the sleeve member 212 may also include a first annular sealing surface 217 for cooperable sealing engagement with a second annular sealing surface 219 disposed about the central bore 206 of the valve body 204. As will be more fully explained below, valve 202 is designed so that when the sleeve member 212 is being moved from an open position (not shown) to a closed position, as shown in FIGS. 17B and 17C, the second valve seat 216 on the sleeve member 212 will come into contact with the first valve seat 210 on the valve body 204 before the first annular sealing surface 217 on the sleeve member 212 comes into contact with the second annular sealing surface 219 on the valve body 204.

Figure 20:
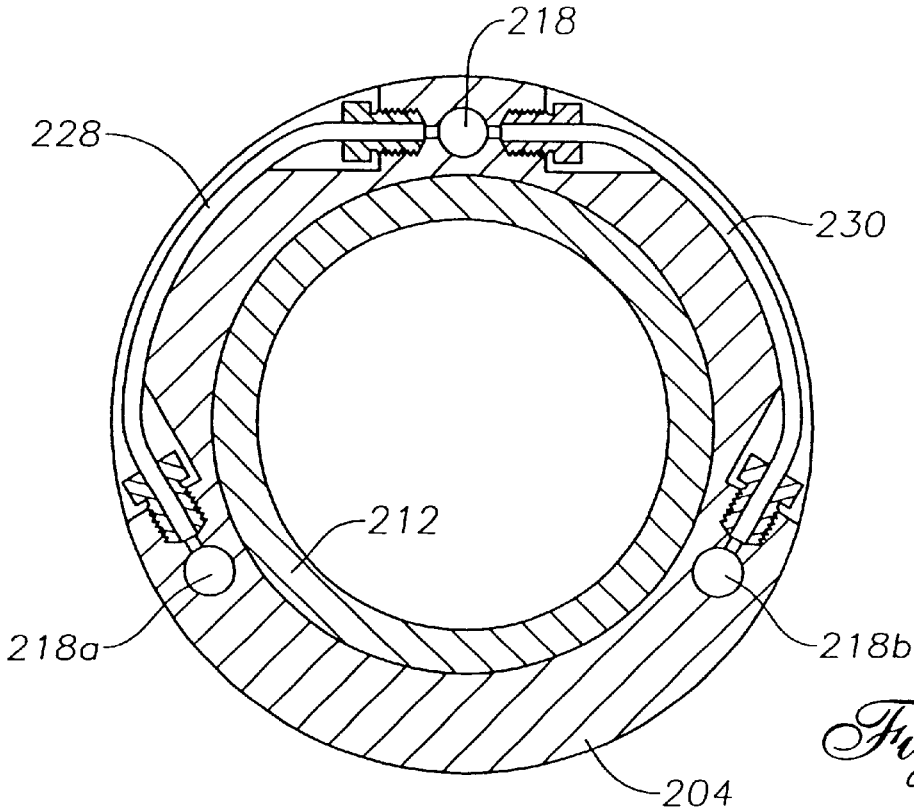
FIG. 20 illustrates a cross section of FIG. 17C taken along line "20—20".
Figure 21:
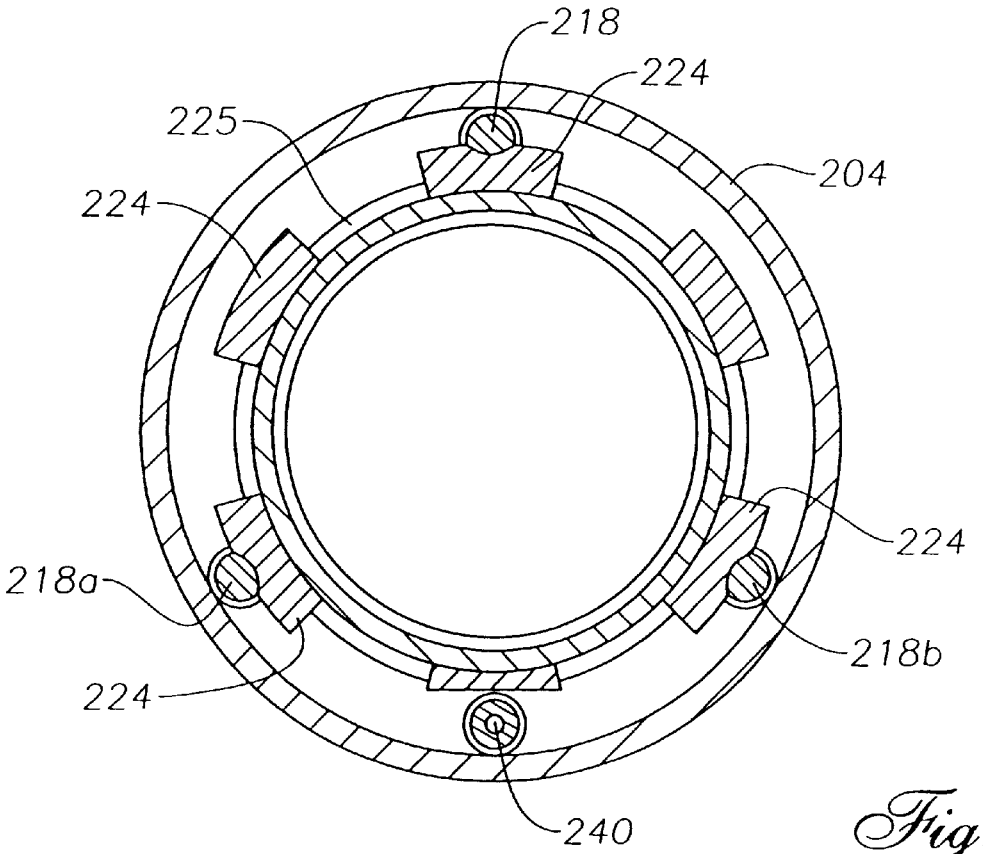
FIG. 21 illustrates a cross section of FIG. 17C taken along line "21—21".
Figure 22:
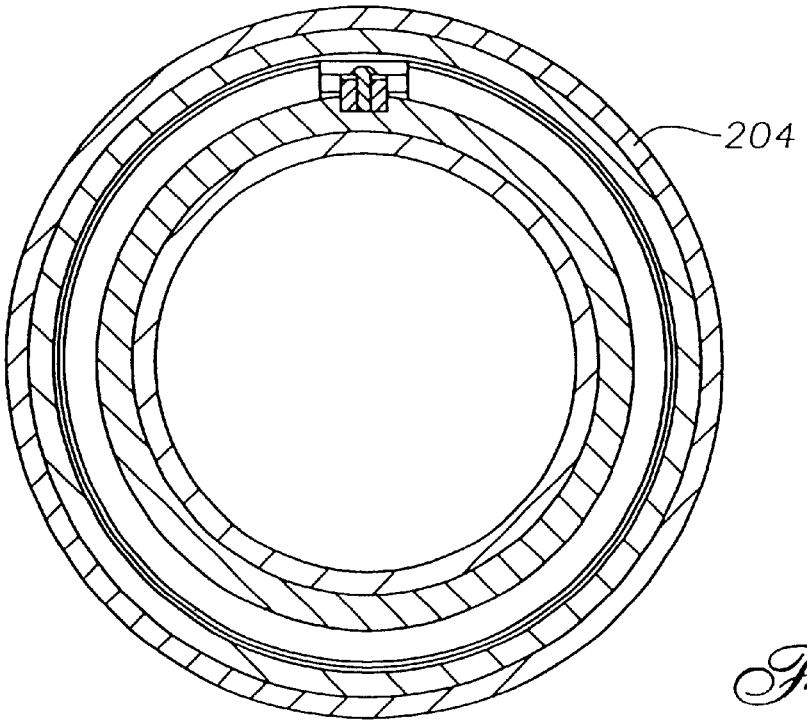
FIG. 22 illustrates a cross section of FIG. 17D taken along line "22—22".
Figure 23:
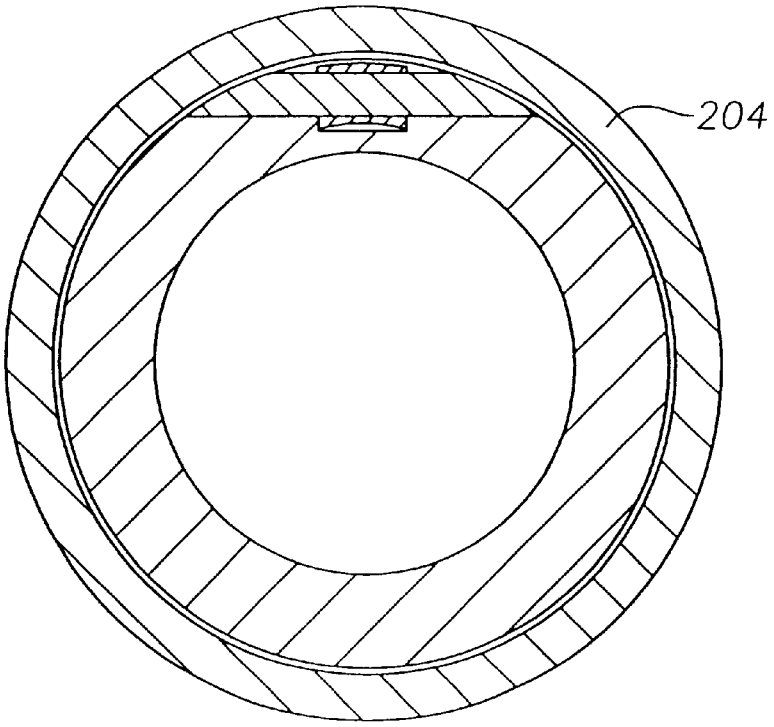
FIG. 23 illustrates a cross section of FIG. 17D taken along line "23—23".

In this embodiment, as shown in FIGS. 17 C–D, at least one piston, such as a rod piston 218, may be connected to, or in contact with, the sleeve member 212, and may be sealably, slidably disposed within at least one upper cylinder 220 and at least one lower cylinder 223 in the valve body 204. In a specific embodiment, the piston 218 may be an annular piston. A first end 221 of the rod piston 218 is in fluid communication with a source of pressurized fluid that is transmitted from a remote location (not shown), such as at the earth's surface (not shown), through a hydraulic conduit 226 that is connected to the valve body 204. As shown in FIG. 20, in a specific embodiment, the valve 202 may include three rod pistons 218, 218*a* and 218*b*, and pressurized fluid may be transmitted from the hydraulic conduit 226 to the rod pistons 218*a* and 218*b* via a first and a second fluid passageway 228 and 230, respectively. In a specific embodiment, the rod piston 218 may include an upper recess 222 in which a shoulder portion 224 of an annular end cap 225 may be received. The annular end cap 224 is connected, as by threads, to a lower end of the sleeve member 212. As pressurized fluid is applied to the first end(s) 221 of the rod piston(s) 218, they will move downwardly within the upper cylinder(s) 220, thereby causing downward movement of the sleeve member 212.

Figure 17A:
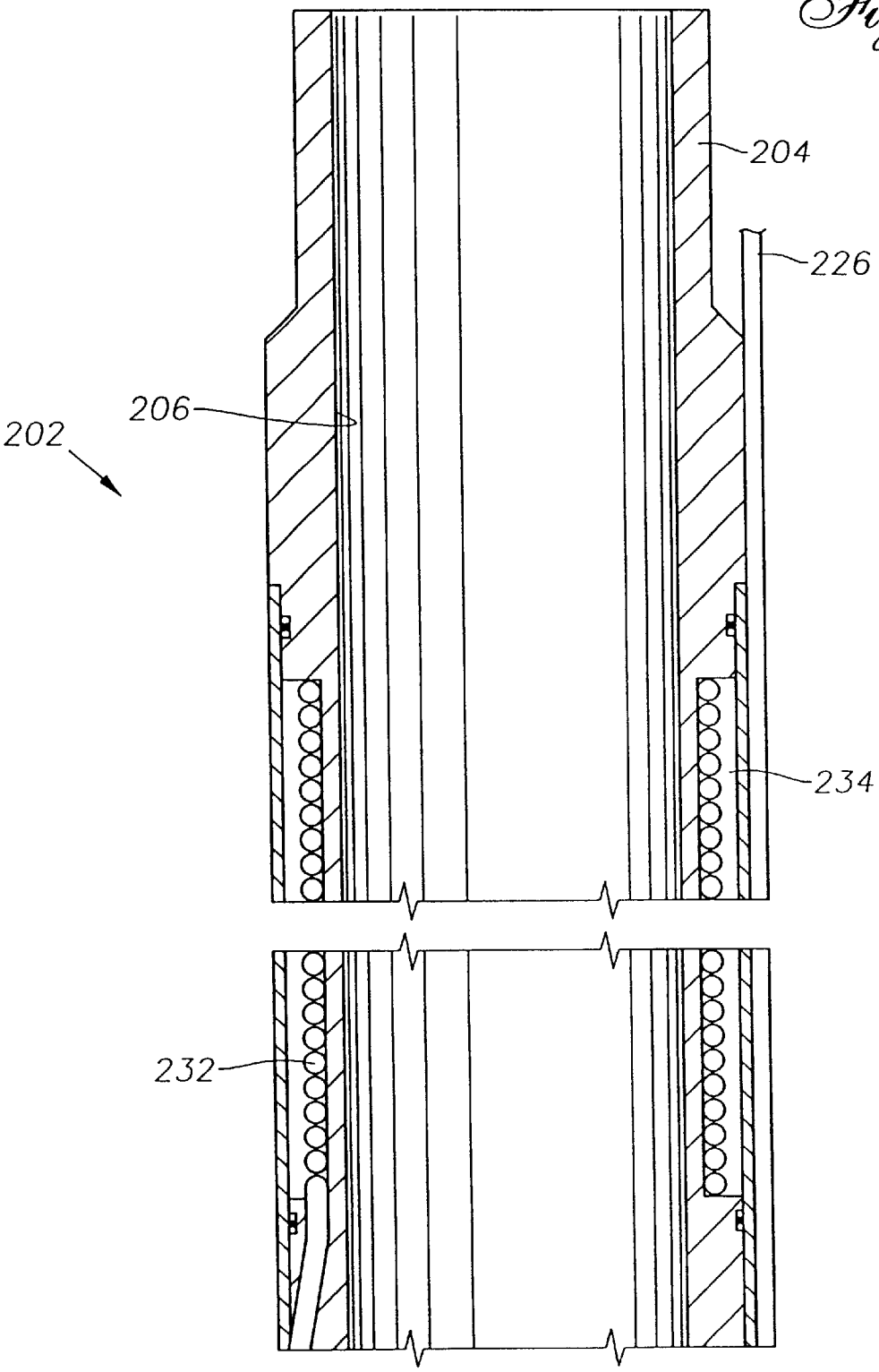
FIGS. 17 A–E taken together form a longitudinal section of another preferred embodiment of an apparatus for remote control of fluid flow within a well.
Figure 17B:
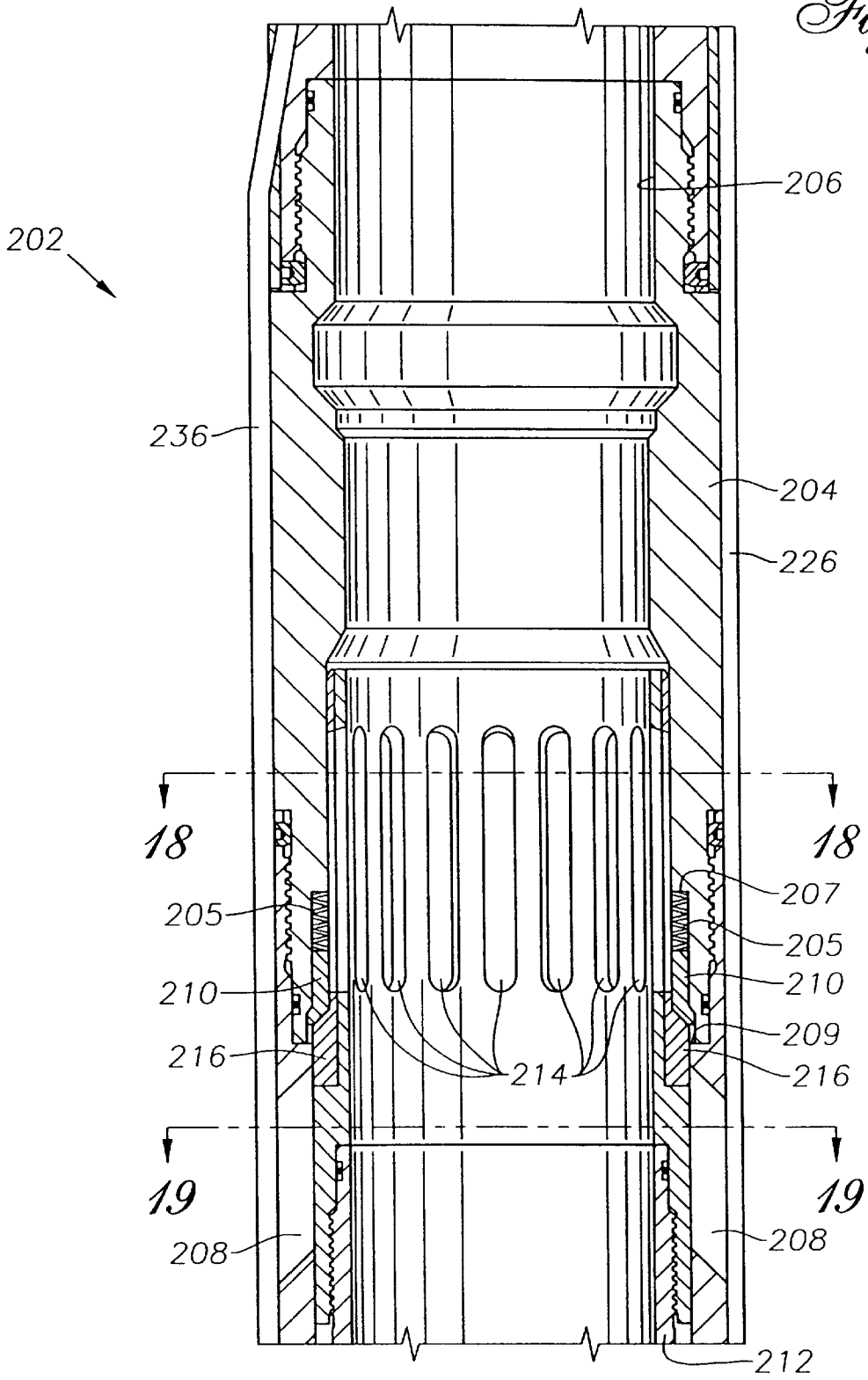
Figure 17C:
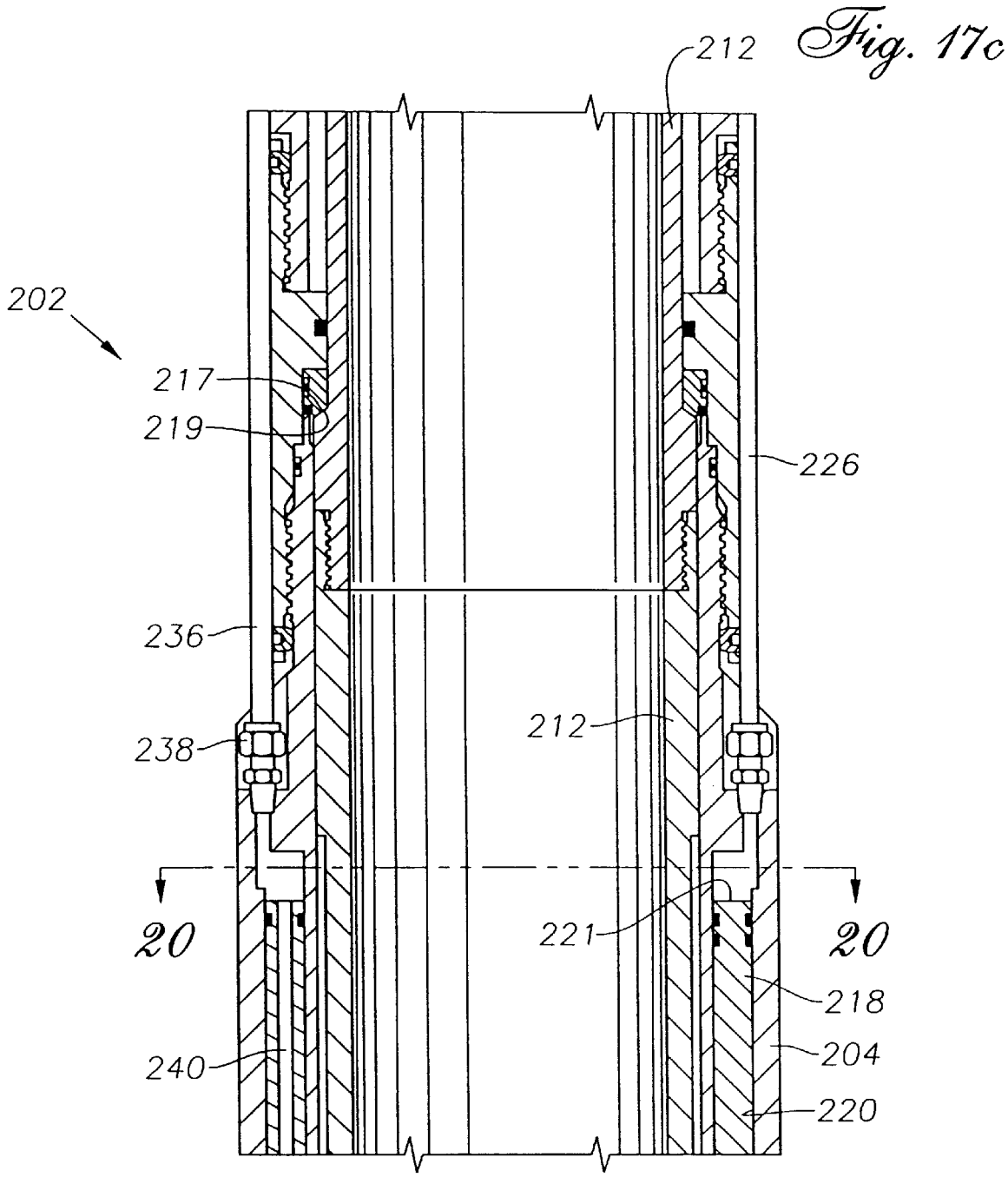
Figure 17D:
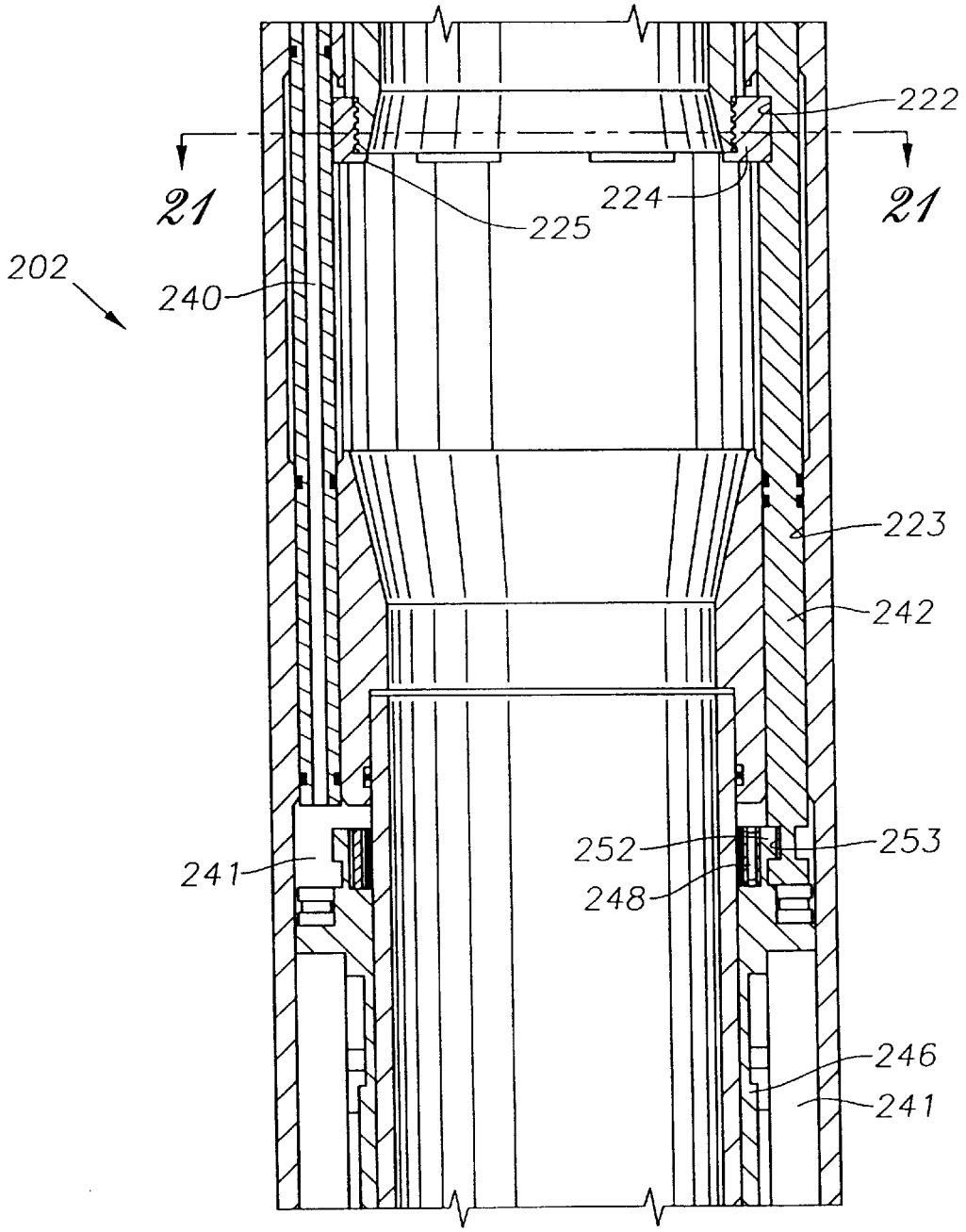
Figure 17E:
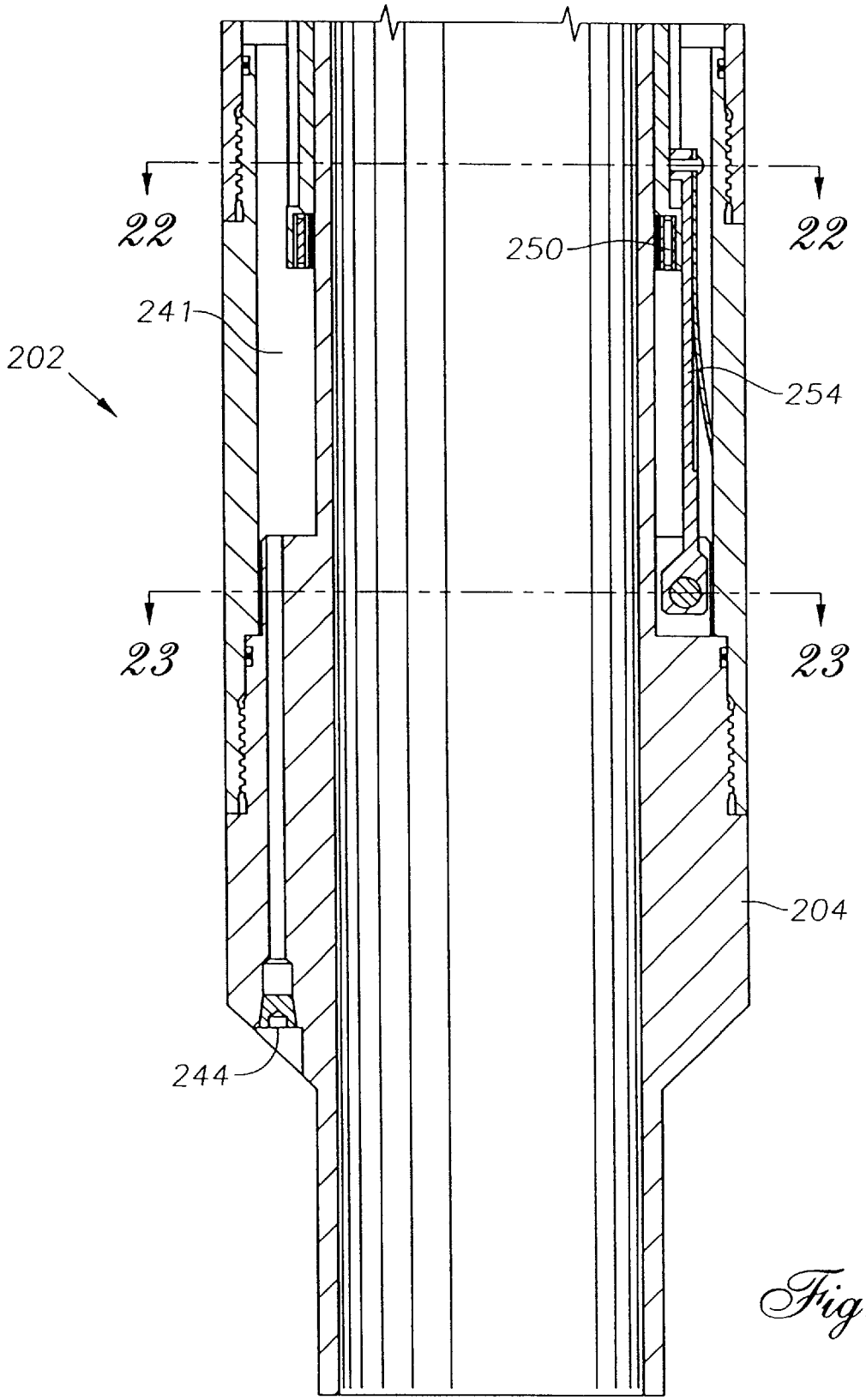
Figure 18:
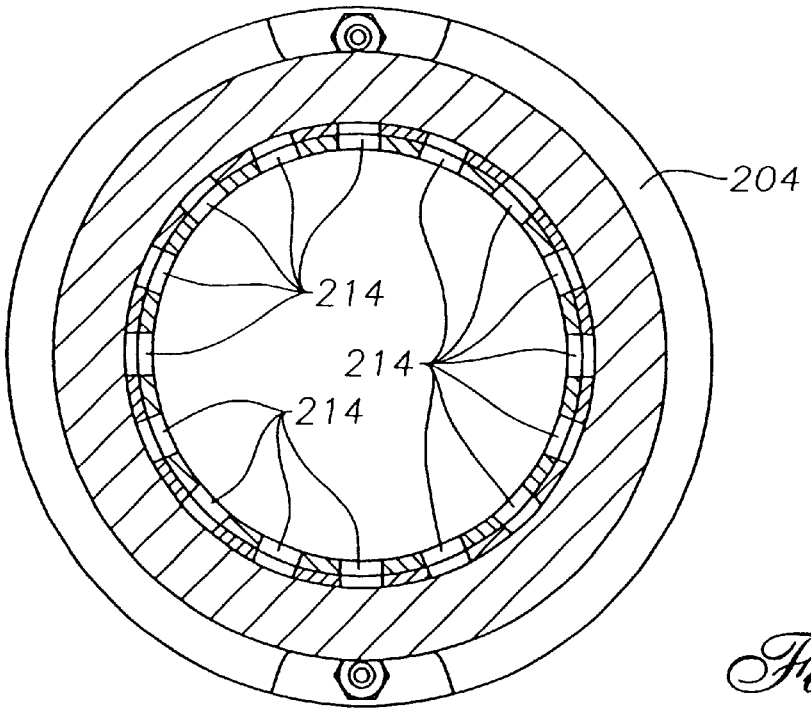
FIG. 18 illustrates a cross section of FIG. 17B taken along line "18—18".
Figure 19:
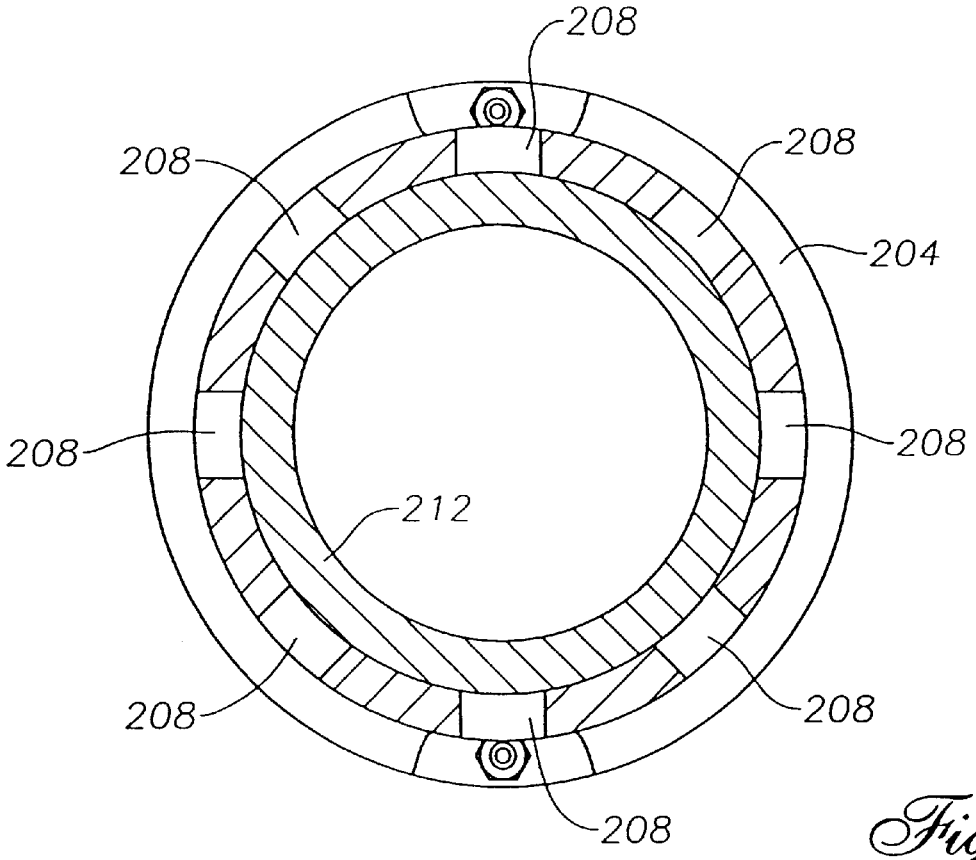
FIG. 19 illustrates a cross section of FIG. 17B taken along line "19—19".

The valve 202 may also be provided with a mechanism for causing upward movement of the sleeve member 212. In this regard, with reference to FIG. 17A, in a specific embodiment, the valve 202 may include a source of pressurized gas, such as pressurized nitrogen, which may be contained within a sealed chamber, such as a gas conduit 232. An upper portion of the gas conduit 232 may be coiled within a housing 234 formed within the body 204, and a lower portion 236 of the gas conduit 232 (FIGS. 17B and 17C) may extend outside the body 204 and terminate at a fitting 238 (FIG. 17C) connected to the body 204. As shown in FIGS. 17 A–D, the gas conduit 232 is in fluid communication with a gas passageway 240 within the body 204 (see also FIG. 21), which is in fluid communication with a second end 242 of the at least one rod piston 218 through a sealably enclosed annular space 241 within the body 204. Appropriate seals are provided to contain the pressurized gas. The gas conduit 232 may further include a fluid barrier, such as oil or silicone. With reference to FIG. 17E, the body 204 may include a charging port 244 through which pressurized gas may be introduced into the valve 202. Mechanisms other than pressurized gas for causing upward movement of the sleeve member 212 (FIG. 17C) are within the scope of the present invention, and may include, for example, a spring (not shown), annulus pressure, tubing pressure, or any combination of pressurized gas, annulus pressure, tubing pressure, and a spring.

With reference to FIGS. 17 C–E, the valve 202 may include a position holder, similar to the position holder discussed above in connection with the embodiment shown in FIGS. 9–16. In this specific embodiment, the position holder may include an indexing cylinder 246 that is slidably disposed within the annular space 241. The indexing cylinder 246 may also be rotatably disposed within the annular space 241, as per bearings 248 and 250. The indexing cylinder 246 may also include a recessed profile, as discussed above and illustrated in FIG. 15. As shown in FIGS. 17 C–E, the indexing cylinder 246 may include a flange 252 that is received within a second recess 253 in the second end 242 of the rod piston 218. In this manner, the rod piston 218 is connected to the indexing cylinder 246, so that the indexing cylinder 246 is movable in response to movement of the piston 218. The position holder also includes a retaining member 254, the structure and operation of which is as described above in connection with the embodiment shown in FIGS. 9–16.

The operation of this embodiment will now be explained. The valve 202 is pre-charged through the charging port 244 with sufficient pressurized gas to maintain the sleeve member 212 biased into its maximum upward, or normally-closed, position, as shown in FIGS. 17A–E, so that the first and second valve seats 210 and 216 are engaged to restrict fluid flow through the at least one flow port 208 in body 204. When it is desired to permit fluid flow through the at least one flow port 208, hydraulic fluid is applied from the hydraulic conduit 226 to the first end 221 of the rod piston 218, with sufficient magnitude to overcome the upward force imparted to the piston 218 by the pressurized gas, thereby forcing the piston 218 downwardly, along with the sleeve member 212 and the indexing cylinder 246. The desired position of the sleeve member 212 is selected by increasing and decreasing pressure in the hydraulic conduit 226 as needed to move the retaining member 254 into the appropriate slot of the recessed profile (recall FIG. 15), during which process the indexing cylinder 246 will rotate and move longitudinally within the enclosed space 241. By adjusting the position of the sleeve member 212, an operator at the earth's surface may remotely regulate fluid flow through the at least one flow port 208 in the body 204 and/or through the at least one flow slot 214 in the sleeve member 212. As noted above, when the sleeve member 212 is being returned to its fully-closed position, the second valve seat 216 on the sleeve member 212 will come into contact with the first valve seat 210 on the valve body 204 before the first annular sealing surface 217 on the sleeve member 212 comes into contact with the second annular sealing surface 219 on the valve body 204. The sleeve member 212 will continue to move upwardly, thereby shifting the first valve seat 210 relative to the body 204 and compressing the wave spring 205, until the first annular sealing surface 217 on the sleeve member 212 comes into contact with the second annular sealing surface 219 on the valve body 204.

Another specific embodiment of the selectively operable flow control valve of the present invention is shown in FIGS. 24 through 31.

With reference to FIGS. 24 A–D, this specific embodiment of the selectively operable flow control valve of the present invention is electrically-operated and identified generally by the reference numeral 256. Referring to FIGS. 24A and B, the valve 256 includes a generally cylindrical body 258 having a central bore 260 extending therethrough, at least one flow port 262 through a sidewall thereof, and a first valve seat 264. In a specific embodiment, as shown in FIGS. 24A and B, the first valve seat 264 may be slidably disposed within the central bore 260, and movable between a first, or uncompressed, position (not shown), and a second, or compressed, position, which is the position illustrated in FIGS. 24A and B. The body 258 may include a downstop shoulder 267 against which the first valve seat 264 abuts when in its first, or uncompressed, position (not shown). In this specific embodiment, the valve 256 may further include a biasing mechanism, such as a wave spring 266, disposed within the central bore 260 and contained between the slidably-disposed first valve seat 264 and a shoulder 270 on the valve body 258. The manner in which the wave spring 266 cooperates with the first valve seat 264 is as explained above in connection with the embodiment shown in FIGS. 17–23. The valve 256 further includes a sleeve member 272 (FIGS. 24A and 24B) that is disposed for longitudinal movement within the central bore 260 of the body 258. The sleeve member 272 may include at least one flow slot 274, and a second valve seat 276 for cooperable sealing engagement with the first valve seat 264 on the body 258. As shown in FIG. 24B, the sleeve member 272 may also include a first annular sealing surface 278 for cooperable sealing engagement with a second annular sealing surface 280 disposed about the central bore 260 of the valve body 258. In the same manner as discussed above in connection with FIGS. 17–23, the valve 256 is designed so that when the sleeve member 272 is being moved from an open position (not shown) to a closed position, as shown in FIGS. 24A–24D, the second valve seat 276 on the sleeve member 272 will come into contact with the first valve seat 264 on the valve body 258 before the first annular sealing surface 278 on the sleeve member 272 comes into contact with the second annular sealing surface 280 on the valve body 258.

Figure 24A:
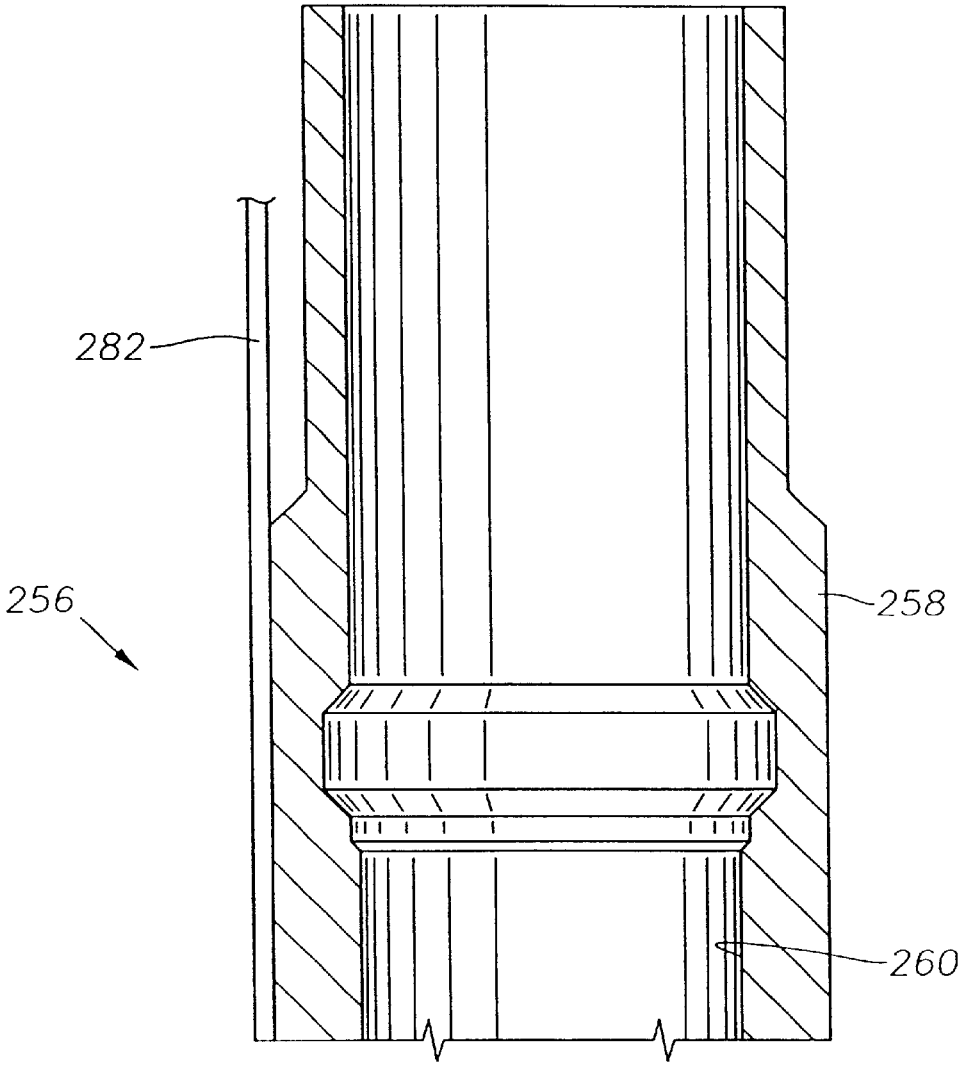
FIGS. 24 A–D taken together form a longitudinal section of another preferred embodiment of an apparatus for remote control of fluid flow within a well.
Figure 24B:
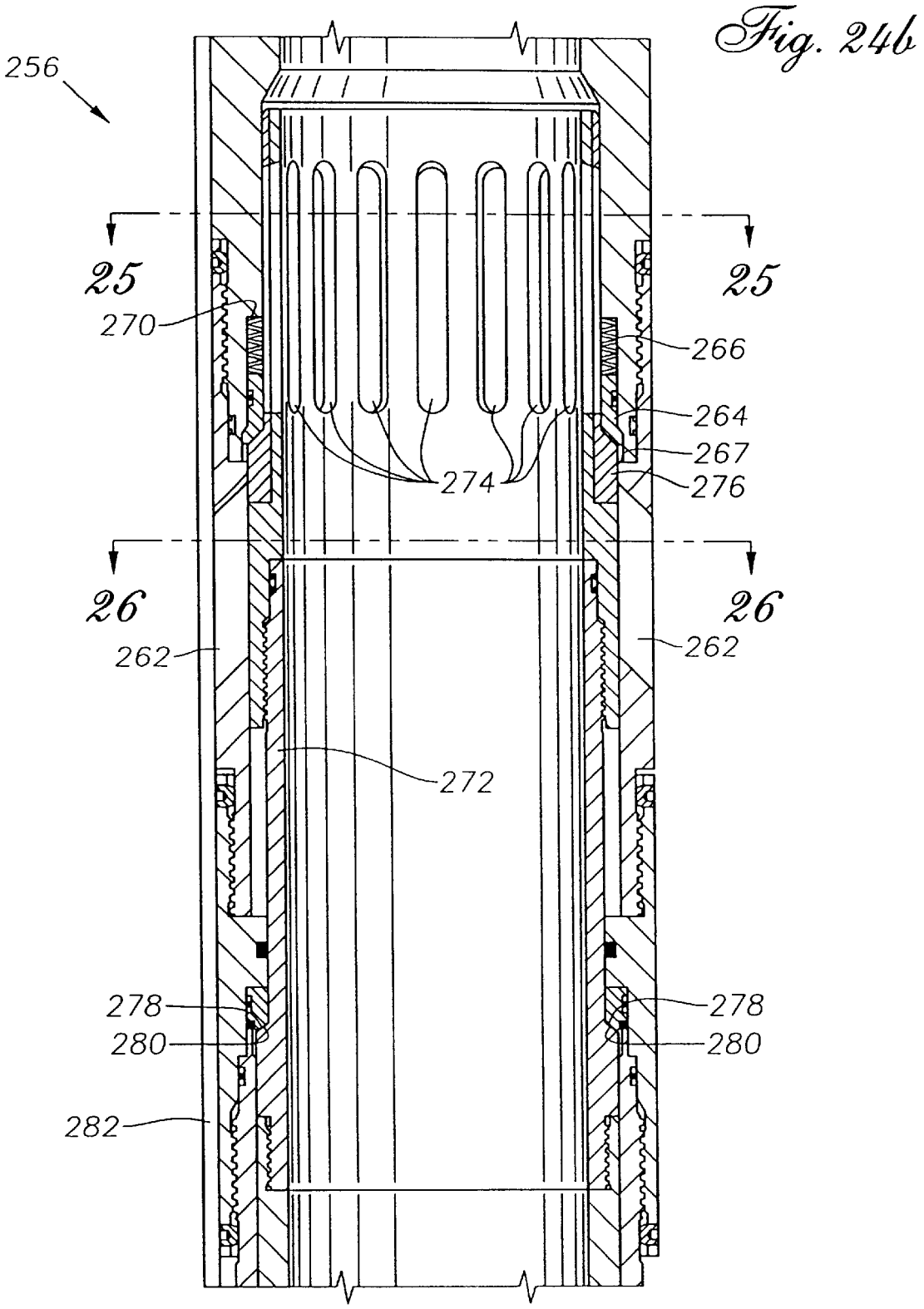
Figure 24C:
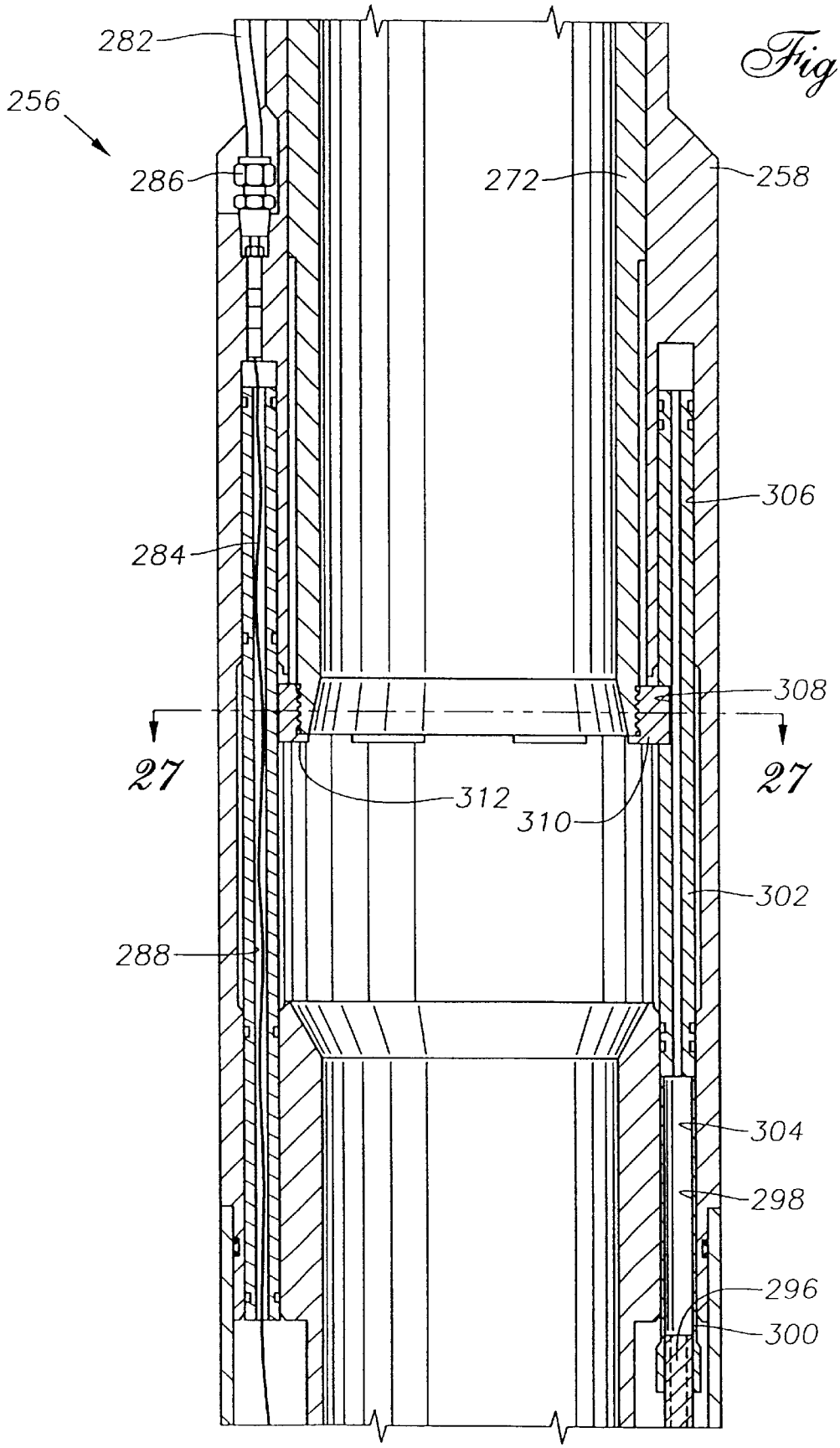
Figure 24D:
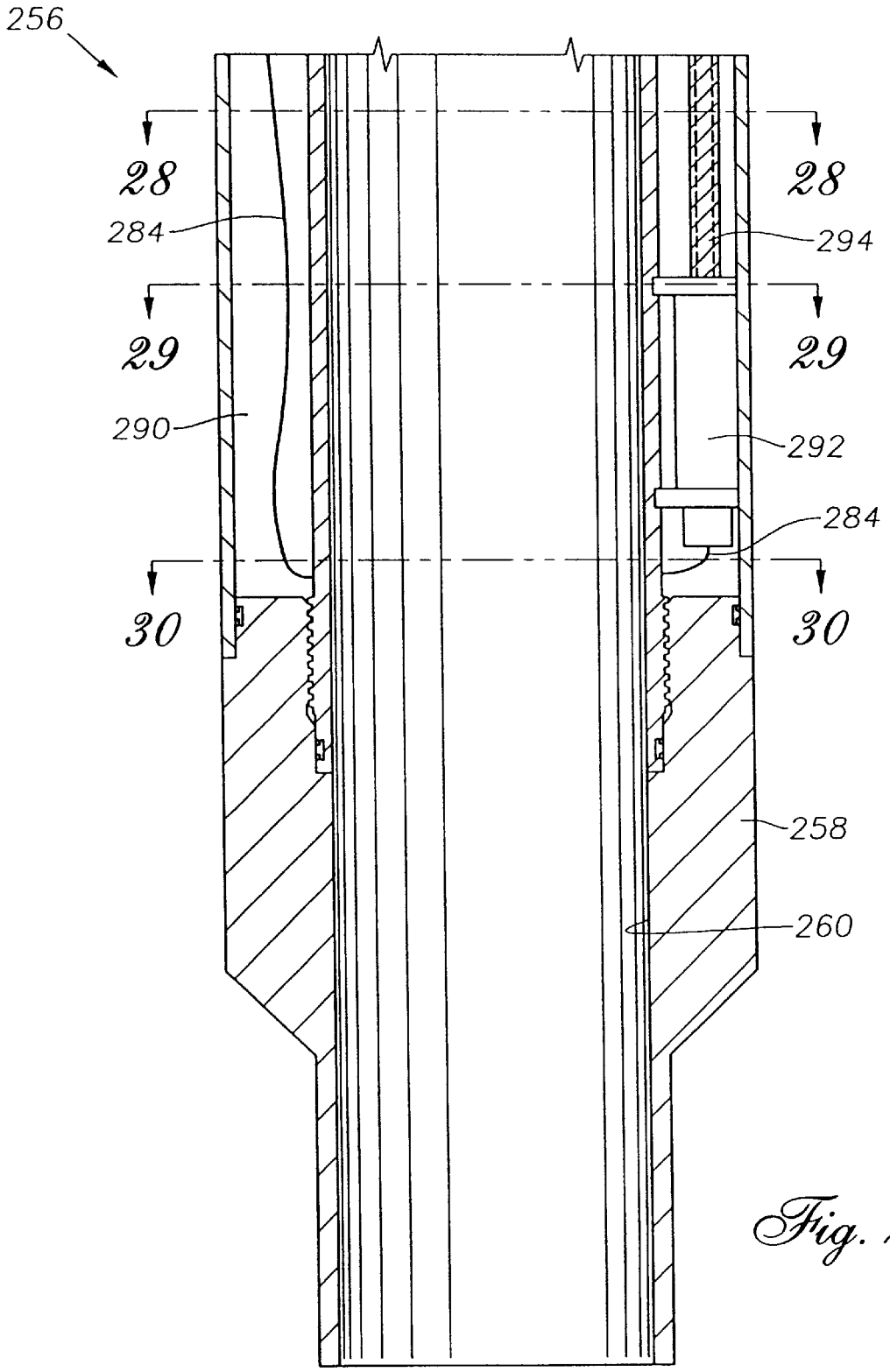
Figure 25:
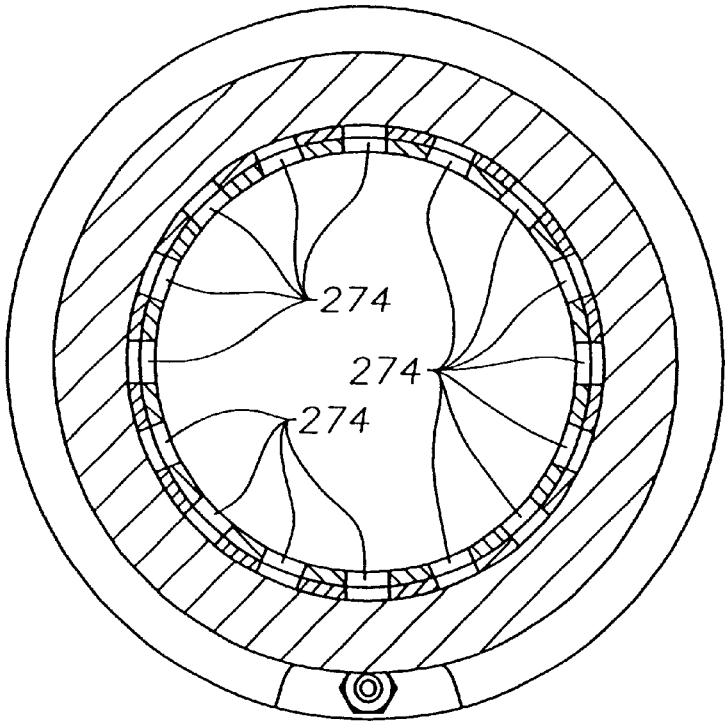
FIG. 25 illustrates a cross section of FIG. 24A taken along line "25—25".
Figure 26:
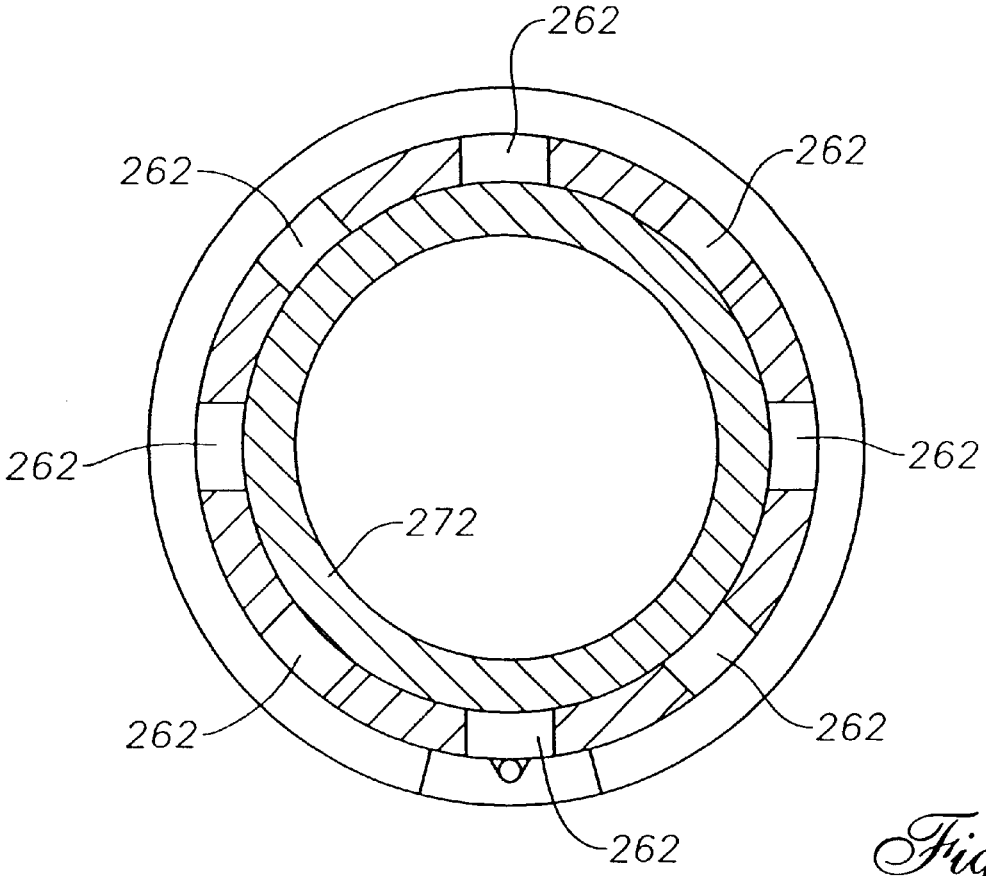
FIG. 26 illustrates a cross section of FIG. 24A taken along line "26—26".

The mechanism of this embodiment for remotely shifting the sleeve member 272 within the central bore 260 is electrically-operated, as will now be more fully explained. With reference to FIGS. 24A–24D, an electrical conduit 282 having at least one electrical conductor 284 disposed therein is connected between a remote source of electrical power (not shown), such as at the earth's surface (not shown), and the valve body 258, such as at fitting 286 (FIG. 24B). The at least one electrical conductor 284 may be passed through a sealed electrical passageway 288 in the valve body 258 to a sealably enclosed annular space 290 in the valve body 258, where it is connected to an electric motor 292. The electric motor 292 is attached to the valve body 258 and adapted to move the sleeve member 272 upon electrical actuation thereof. In a specific embodiment, the electric motor 292 may include, or be connected to, a threaded rod 294, or ball screw, a distal end 296 of which may be threadably received within a threaded cylinder 298 in a proximal end 300 of an actuating member 302. Referring to FIG. 24C, in a specific embodiment, the actuating member 300 may be a rod piston that is movably disposed within a lower cylinder 304 and an upper cylinder 306, both of which cylinders 304 and 306 may be disposed within the valve body 258. In a specific embodiment, the rod piston 300 may include a recess 308 in which a shoulder portion 310 of an annular end cap 312 may be received. In a specific embodiment, the actuating member 300 may be an annular piston. The annular end cap 312 is connected, as by threads, to a lower end of the sleeve member 272. Referring to FIG. 24D, the threaded rod 294 may be rotated in a clockwise or counter-clockwise direction upon electrical actuation of the motor 292, thereby resulting in longitudinal movement of the threaded rod 294 within the threaded cylinder 298 (FIG. 24C). This causes longitudinal movement of the rod piston 300 within the lower and upper cylinders 304 and 306, which results in longitudinal movement of the sleeve member 272 within the central bore 260. In this manner, fluid flow may be remotely regulated through the at least one flow port 262 in the valve body 258 and/or through the at least one flow slot 274 in the sleeve member 272.

Figure 28:
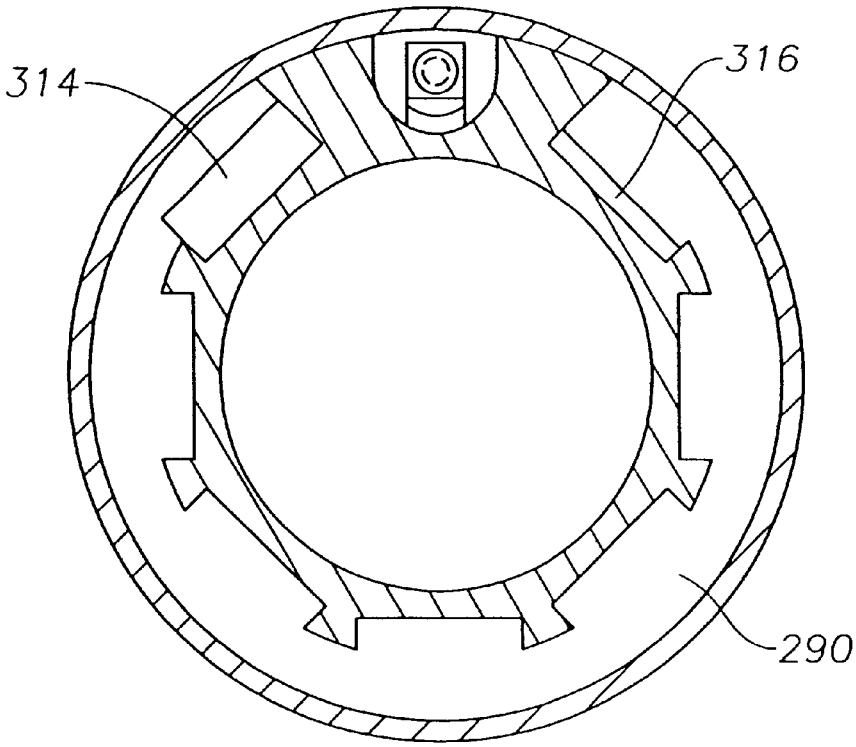
FIG. 28 illustrates a cross section of FIG. 24C taken along line "28—28".
Figure 29:
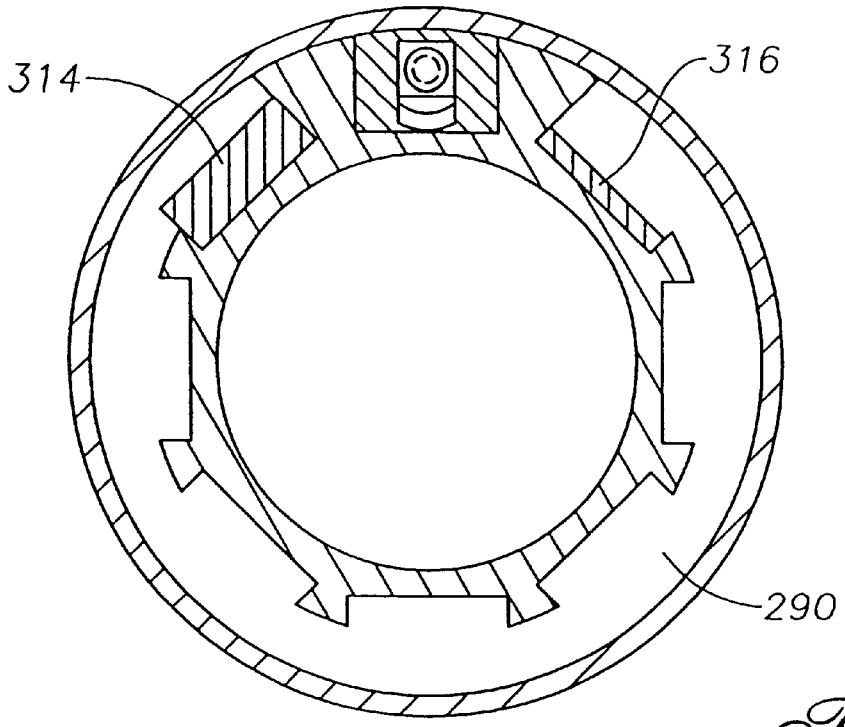
FIG. 29 illustrates a cross section of FIG. 24C taken along line "29—29".
Figure 30:
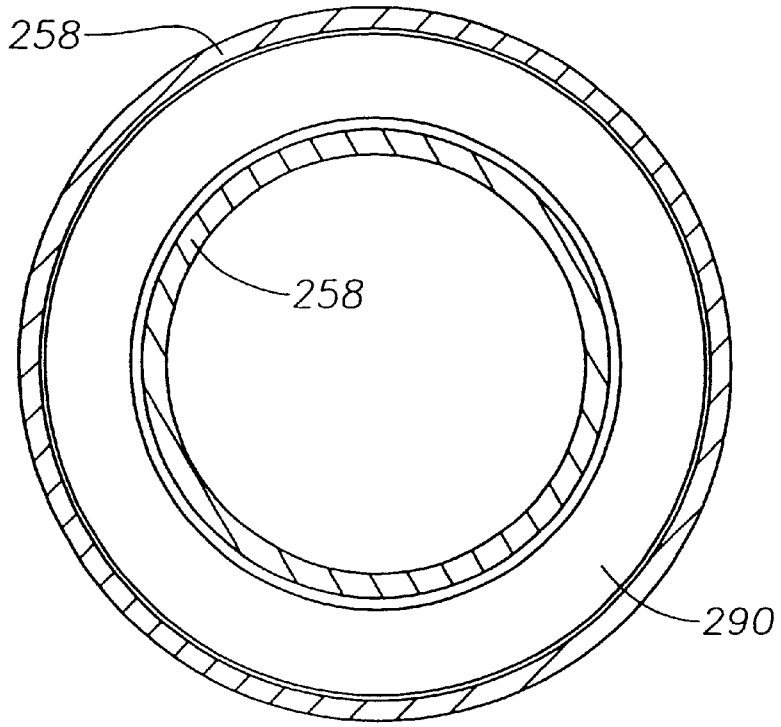
FIG. 30 illustrates a cross section of FIG. 24C taken along line "30—30".

In a specific embodiment, as shown in FIGS. 28 and 29, the valve 256 may also include a position indicator 314 that is connected to the at least one electrical conductor 284 and to the motor 292. The position indicator 314 will provide a signal to a control panel (not shown) at the earth's surface to indicate the position of the threaded rod 294, which will provide an indication to the operator at the earth's surface of the distance between the first and second valve seats 264 and 276 (FIG. 24A). This information will assist the operator in regulating fluid flow through the at least one flow port 262 in the valve body 258 and/or through the at least one flow slot 274 in the sleeve member 272. In a specific embodiment, the position indicator 314 may be a rotary variable differential transformer (RVDT). In a specific embodiment, the RVDT 314, the motor 292, and the threaded rod 294 may be an integral unit, of the type available from Astro Corp., of Dearfield, Fla., such as Model No. 800283. In another specific embodiment, the position indicator 314 may be an electromagnetic tachometer. In another specific embodiment, if the motor 292 is a stepper motor, the position indicator 314 may be a step counter for counting the number of times the stepper motor 292 has been advanced. In another specific embodiment, the position indicator 314 may be an electrical resolver. In a specific embodiment, the valve 256 may further include an electronic module 316 connected between the electrical conductor 284 and the motor 292 to control operation thereof. The module 316 may include hard-wired circuitry, and/or a microprocessor and associated software.

Figure 27:
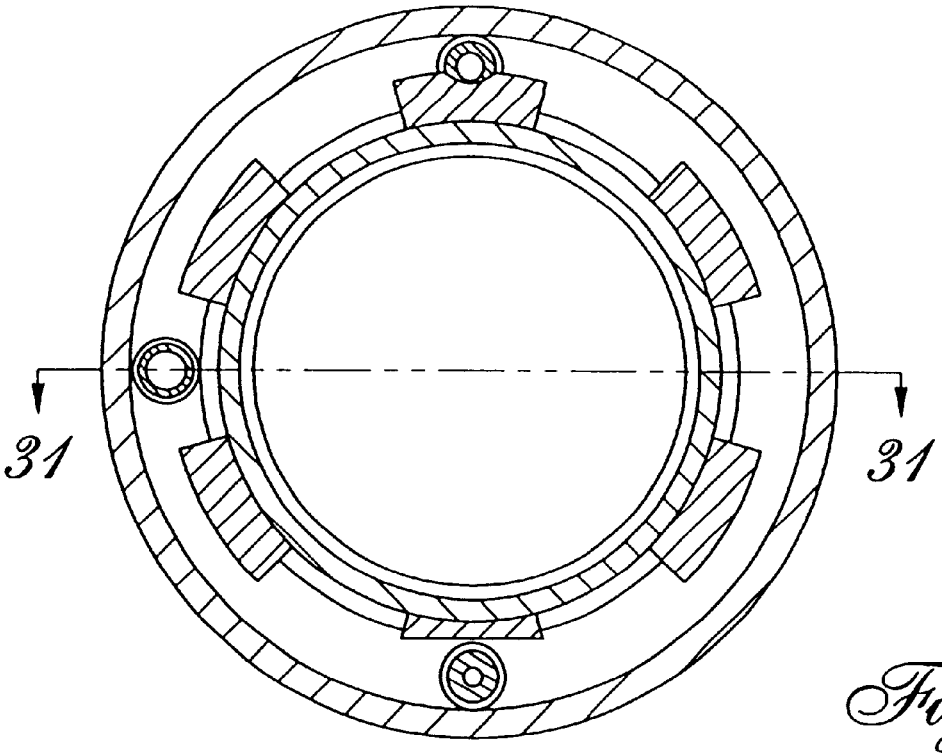
FIG. 27 illustrates a cross section of FIG. 24B taken along line "27—27".
Figure 31:
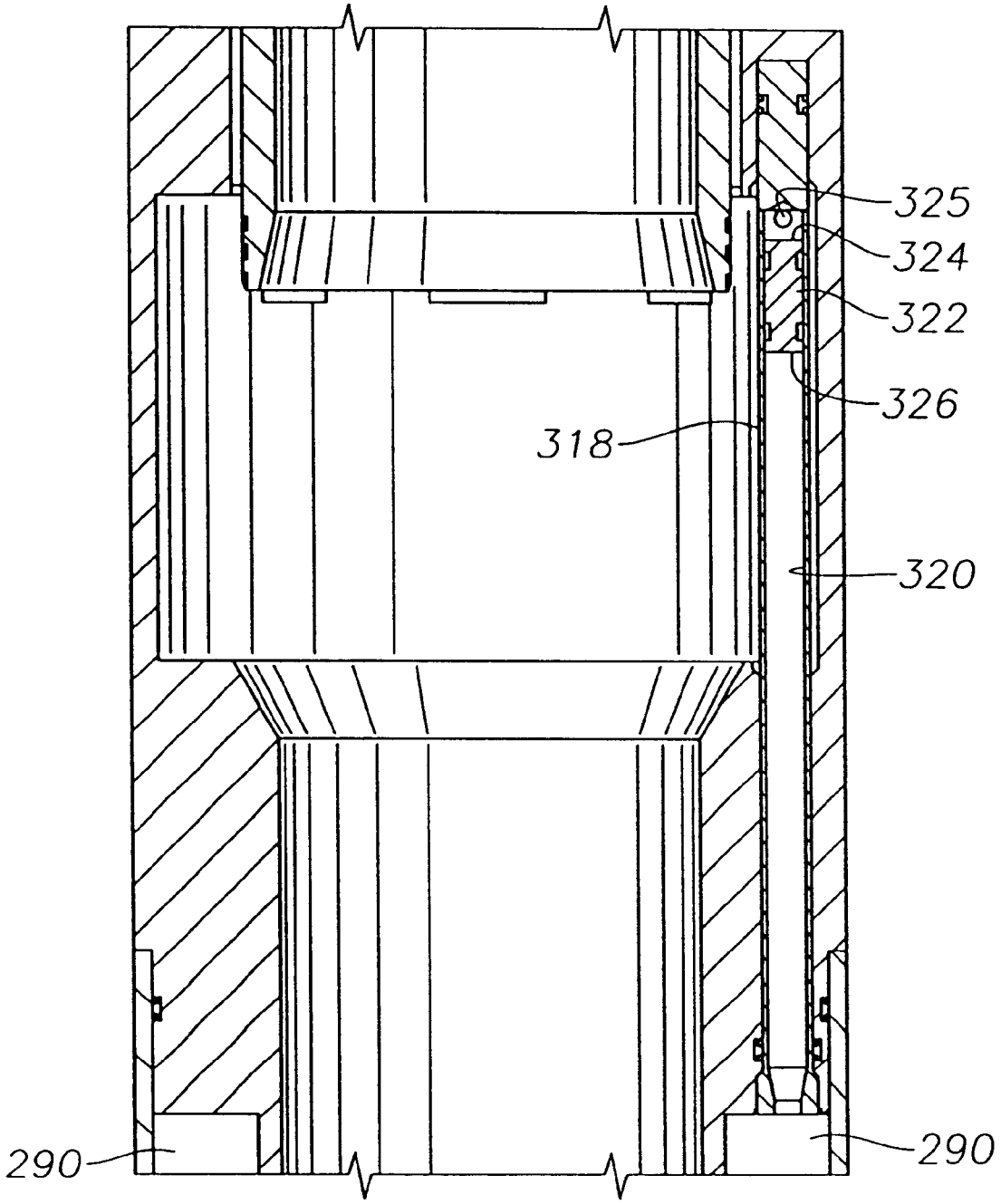
FIG. 31 illustrates a longitudinal cross section of FIG. 27 taken along line "31—31".

Referring now to FIGS. 27 and 31, this embodiment of the present invention may also include a mechanism for compensating for temperature-induced pressure variations between pressures in the well annulus (not shown) and in the enclosed annular space 290, which may contain an incompressible fluid. As shown in FIG. 31, the compensating mechanism may include a compensator housing 318 having a compensator cylinder 320 in which a compensator piston 322 is movably disposed. The compensator housing 318 may be connected to or a part of the valve body 258. A first side 324 of the compensator piston 322 is in fluid communication with the well annulus, such as through an aperture 325, and a second side 326 of the compensator piston 322 is in fluid communication with the enclosed space 290. As the valve experiences fluctuations in temperature and pressure, the compensator piston 322 will move within the compensator cylinder 320 to maintain equilibrium between annulus pressure and the pressure in the enclosed space 290.

Whereas the present invention has been described in particular relation to the drawings attached hereto, it is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A multilateral production system comprising:

a main wellbore adapted to receive fluid flow;

a first selectively operable flow control valve in communication with the fluid flow from the main wellbore, the first selectively operable flow control valve having an interior bore, the flow control valve adapted to regulate the fluid flow into its interior bore;

at least one lateral wellbore adapted to receive fluid flow;

a second selectively operable flow control valve in communication with the fluid flow of the at least one lateral wellbore; the second selectively operable flow control valve having an interior bore, the flow control valve adapted to regulate the fluid flow into its interior bore; and at least one of the first and second flow control valves being operable from the surface, the first and second flow control valves adapted for interconnection to the production tubing.

2. The multilateral production system of claim 1, wherein the first and second selectively operable flow control valves are sleeve valves.

3. The multilateral production system of claim 1, wherein the first and second selectively operable flow control valves are in communication with production tubing.

4. The multilateral production system of claim 1, wherein both the first and second selectively operable flow control valves are operable from the surface.

5. A multilateral production system comprising:

a production tubing defining an interior bore;

a main wellbore adapted to receive fluid flow;

one or more lateral wellbores adapted to receive fluid flow;

a plurality of flow control valves interconnected with the production tubing, each of the plurality of flow control valves in communication with the fluid flow of at least one of the main wellbore and the one or more lateral wellbores, the plurality of flow control valves adapted to regulate fluid flow between the wellbores and the interior bore of the production tubing; and at least one of the flow control valves being operable from the surface.

6. The multilateral production system of claim 5, wherein the flow control valves are sleeve valves.

7. The multilateral production system of claim 5, wherein all of the plurality of flow control valves are operable from the surface.

8. The system of claim 7, wherein:

the one or more lateral wellbores comprises a first and a second lateral wellbore;

the plurality of flow control valves comprises a first flow control valve, a second flow control valve and a third flow control valve;

the first flow control valve is adapted to regulate the fluid flow from the main wellbore;

the second flow control valve is adapted to regulate the fluid flow from the first lateral wellbore; and the third flow control valve is adapted to regulate the fluid flow from the second lateral wellbore.

9. The system of claim 8, wherein:

the first flow control valve is operable from the surface to vary between its open position and its closed position;

when the first flow control valve is in its open position, fluid from the main wellbore flows into the production tubing through the open first flow control valve; and when the first flow control valve is in its closed position, fluid from the main wellbore is prevented from entering the production tubing through the closed first flow control valve.

10. The system of claim 8, wherein:

the second flow control valve is operable from the surface to vary between its open position and its closed position;

when the second flow control valve is in its open position, fluid from the first lateral wellbore flows into the production tubing through the second flow control valve; and when the second flow control valve is in its closed position, fluid from the first lateral wellbore is prevented from entering the production tubing through the closed second flow control valve.

11. The system of claim 8, wherein:

the third flow control valve is operable from the surface to vary between its open position and its closed position;

when the third flow control valve is in its open position, fluid from the second lateral wellbore flows into the production tubing through the third flow control valve; and when the third flow control valve is in its closed position, fluid from the second lateral wellbore is prevented from entering the production tubing through the closed third flow control valve.

12. The system of claim 8, wherein:

the first and second lateral wellbores intersect the main wellbore; and the second flow control valve is located above the intersection between the first lateral wellbore and the main wellbore; and the third flow control valve is located above the intersection between the second lateral wellbore and the main wellbore.

13. The system of claim 8, wherein the first flow control valve, the second flow control valve, and the third flow control valve are operable from the surface to enable commingling of fluid from the main wellbore, first lateral wellbore, and the second lateral wellbore.

14. A method of controlling flow in a multilateral well, the method comprising:

receiving fluid flow from a main wellbore and one or more lateral wellbores;

providing a selectively operable first flow control valve in communication with the main wellbore, the first flow control valve having a central bore and being operable from the surface;

providing one or more selectively operable lateral flow control valves in communication with the one or more lateral wellbores, each of the one or more lateral flow control valves having a central bore, each of the one or more lateral flow control valves interconnected to the production tubing, and each of the one or more lateral flow control valves being operable from the surface; and selectively regulating the flow of fluid into the central bores of the first flow control valve and the one or more lateral control valves.

15. A multilateral production system, comprising:

a main wellbore; and one or more lateral wellbores, the main wellbore and each lateral wellbore in fluid communication with an associated control valve, each control valve having an interior bore and a body, each control valve interconnected to the production tubing, each control valve adapted to regulate fluid flow between the outside of its body and its interior bore, and each control valve operable from the surface.

* * * * *